US006064843A

United States Patent [19]

Isobe et al.

[11] Patent Number: 6,064,843

[45] Date of Patent: May 16, 2000

[54] PROCESS CARTRIDGE AND IMAGE FORMING APPARATUS

[75] Inventors: Hironobu Isobe, Yokohama; Atsushi Kubota, Machida; Yoshiya Nomura, Tokyo; Kanji Yokomori; Shigeo Miyabe, both of Yokohama, all of Japan

[73] Assignee: Canon Kabushiki Kaisha, Tokyo, Japan

[21] Appl. No.: 08/907,780

[22] Filed: Aug. 11, 1997

Related U.S. Application Data

[63] Continuation of application No. 08/426,849, Apr. 24, 1995, abandoned.

[30] Foreign Application Priority Data

| | | | |
|---|---|---|---|
| Apr. 26, 1994 | [JP] | Japan | 6-088318 |
| Apr. 11, 1995 | [JP] | Japan | 7-085296 |
| Apr. 19, 1995 | [JP] | Japan | 7-093691 |

[51] Int. Cl.[7] ..... G03G 21/16

[52] U.S. Cl. ..... 399/111; 399/113; 399/114

[58] Field of Search ..... 355/200, 210, 355/211; 399/110, 111, 113, 114

[56] References Cited

U.S. PATENT DOCUMENTS

| | | | |
|---|---|---|---|
| 3,985,436 | 10/1976 | Tanaka et al. . | |
| 4,785,319 | 11/1988 | Fujino et al. . | |
| 4,873,548 | 10/1989 | Kobayashi et al. . | |
| 4,912,563 | 3/1990 | Narita | 358/401 |
| 4,924,267 | 5/1990 | Yoshikawa et al. . | |
| 4,952,989 | 8/1990 | Kawano et al. . | |
| 5,027,152 | 6/1991 | Oda et al. | 355/200 |
| 5,028,966 | 7/1991 | Kozuka et al. | 355/210 X |
| 5,047,803 | 9/1991 | Kanoto . | |
| 5,115,272 | 5/1992 | Ohmori et al. . | |
| 5,204,713 | 4/1993 | Yamamura | 355/210 |
| 5,206,682 | 4/1993 | Yamada et al. | 355/200 |
| 5,331,373 | 7/1994 | Nomura et al. . | |
| 5,345,294 | 9/1994 | Nomura et al. . | |
| 5,414,492 | 5/1995 | Kubota | 355/200 |

FOREIGN PATENT DOCUMENTS

| | | |
|---|---|---|
| 0163486 | 12/1985 | European Pat. Off. . |
| 0276910 | 8/1988 | European Pat. Off. . |
| 0285139 | 10/1988 | European Pat. Off. . |

(List continued on next page.)

OTHER PUBLICATIONS

EPO 520 802 A3, Abstract, published Dec. 30, 1992.
EPO 042 A3, Abstract, published Jun. 15, 1993.
Patent Abstracts of Japan, vol. 15, No. 287 (Jul. 22, 1991).
Patent Abstracts of Japan, vol. 12, No. 34 (Feb. 2, 1988).
Patent Abstracts of Japan, vol. 13, No. 550 (Dec. 8, 1989).

*Primary Examiner*—Matthew S. Smith
*Attorney, Agent, or Firm*—Fitzpatrick, Cella, Harper & Scinto

[57] ABSTRACT

A process cartridge detachably mountable to a main assembly of an image forming apparatus includes an electrophotographic photosensitive member; a process cartridge actable on the photosensitive member; a cartridge frame; a first projection for positioning the process cartridge relative to the main assembly when the process cartridge is mounted to the main assembly, the first projection being outwardly projected from a first frame of the cartridge frame adjacent an axial end of the photosensitive member; a second projection for positioning the process cartridge relative to the main assembly when the process cartridge is mounted to the main assembly, the second projection being outwardly projected from a second frame of the cartridge frame adjacent another axial end of the photosensitive member; a confining contact portion, in the cartridge frame, for contacting a first fixed portion of the main assembly and cooperating with the first projection and second projection to correctly position the process cartridge relative to the main assembly, when the process cartridge is mounted to the main assembly; and a releasing contact portion, in the cartridge frame, for contacting a second fixed portion of the main assembly to provide a pivot of rotation of the process cartridge, when the process cartridge is demounted from the main assembly.

180 Claims, 22 Drawing Sheets

U.S. PATENT DOCUMENTS

| | | | |
|---|---|---|---|
| 5,450,166 | 9/1995 | Yashiro | 355/210 |
| 5,452,056 | 9/1995 | Nomura et al. | 355/200 |
| 5,477,306 | 12/1995 | Iguchi et al. | 355/210 |

FOREIGN PATENT DOCUMENTS

| | | | |
|---|---|---|---|
| 0397465 | 11/1990 | European Pat. Off. . | |
| 0405514 | 1/1991 | European Pat. Off. . | |
| 0407183 | 1/1991 | European Pat. Off. . | |
| 0520802 | 12/1992 | European Pat. Off. . | |
| 0586042 | 3/1994 | European Pat. Off. . | |
| 0586043 | 3/1994 | European Pat. Off. | 355/210 |
| 3236854 | 4/1983 | Germany . | |
| 62-186274 | 8/1987 | Japan . | |
| 1-229270 | 9/1989 | Japan . | |
| 3-98061 | 4/1991 | Japan . | |
| 3-252665 | 11/1991 | Japan . | |
| 3-252667 | 11/1991 | Japan . | |
| 3-252668 | 11/1991 | Japan . | |
| 3-252669 | 11/1991 | Japan . | |
| 0086675 | 3/1992 | Japan | 355/210 |
| 0090561 | 3/1992 | Japan | 355/210 |
| 4-70767 | 3/1992 | Japan . | |
| 4-90561 | 3/1992 | Japan . | |
| 303242 | 11/1993 | Japan . | |
| WO92/18910 | 10/1992 | WIPO . | |

PROCESS CARTRIDGE AND IMAGE FORMING APPARATUS

This application is continuation of application Ser. No. 08/426,849, filed Apr. 24, 1995, now abandoned.

FIELD OF THE INVENTION AND RELATED ART

The present invention relates to a process cartridge and an image forming apparatus usable with the process cartridge.

Here, the image forming apparatus includes an electrophotographic copying machine, an electrophotographic printer (for example, an LED printer, a laser beam printer, etc.), an electrophotographic facsimile machine, an electrophotographic word processor, and the like.

The process cartridge means a cartridge having as a unit an electrophotographic photosensitive member, and charging means, developing means and cleaning means, which is detachably mountable to a main assembly of an image forming apparatus. It may include as a unit an electrophotographic photosensitive member and at least one of charging means, developing means and cleaning means. It may include as a unit developing means and an electrophotographic photosensitive member.

An image forming apparatus using an electrophotographic process is known which is used with the process cartridge. This is advantageous in that the maintenance operation can be, in effect, carried out by the users thereof without expert service persons, and therefore, the operability can be remarkably improved. Therefore, this type is now widely used.

In the process cartridge, improvement in the operability in mounting and demounting relative to the main assembly of the image forming apparatus, is desired.

U.S. Pat. Nos. 4,873,548 and 5,047,803 and EP-A 520802 propose some improvements.

In U.S. Pat. No. 4,873,548, a first frame is provided with a positioning member, and the process cartridge is mounted to the second frame, and when the frame is closed, the positioning member functions to effect the positioning.

U.S. Pat. No. 5,047,803 proposes that in order to facilitate removal of the process cartridge from the main assembly of the image forming apparatus, an urging force is applied to the process cartridge in response to opening of the openable and closable member.

In EP-A 520802, an abutment is provided on the top surface of the process cartridge, wherein when the process cartridge is mounted to the main assembly of the image forming apparatus, the abutment is contacted to a fixed portion of the main assembly, by which the accuracy of the mounting position is improved.

They are effective to improve the mounting and demounting operability.

Further improvement is desirable.

SUMMARY OF THE INVENTION

Accordingly, it is a principal object of the present invention to provide a process cartridge and an image forming apparatus usable with the process cartridge wherein the process cartridge can be positioned correctly in place.

It is another object of the present invention to provide a process cartridge and an image forming apparatus usable with the process cartridge wherein the mounting and demounting of the process cartridge is easy.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, preferable embodiments of the present invention will be described.

Figure 1:
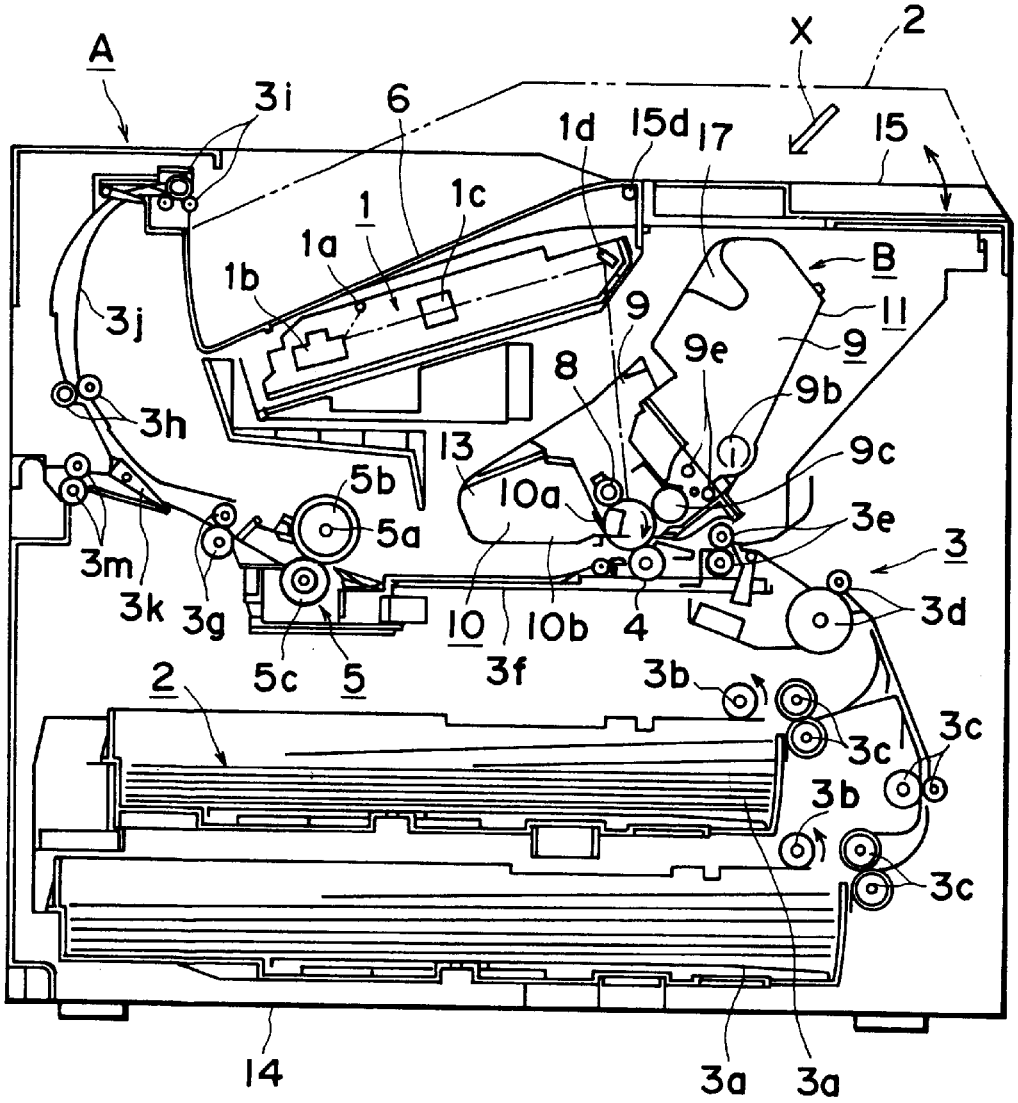
FIG. 1 is a sectional view of the first embodiment of an electrophotographic image forming apparatus according to the present invention.
Figure 2:
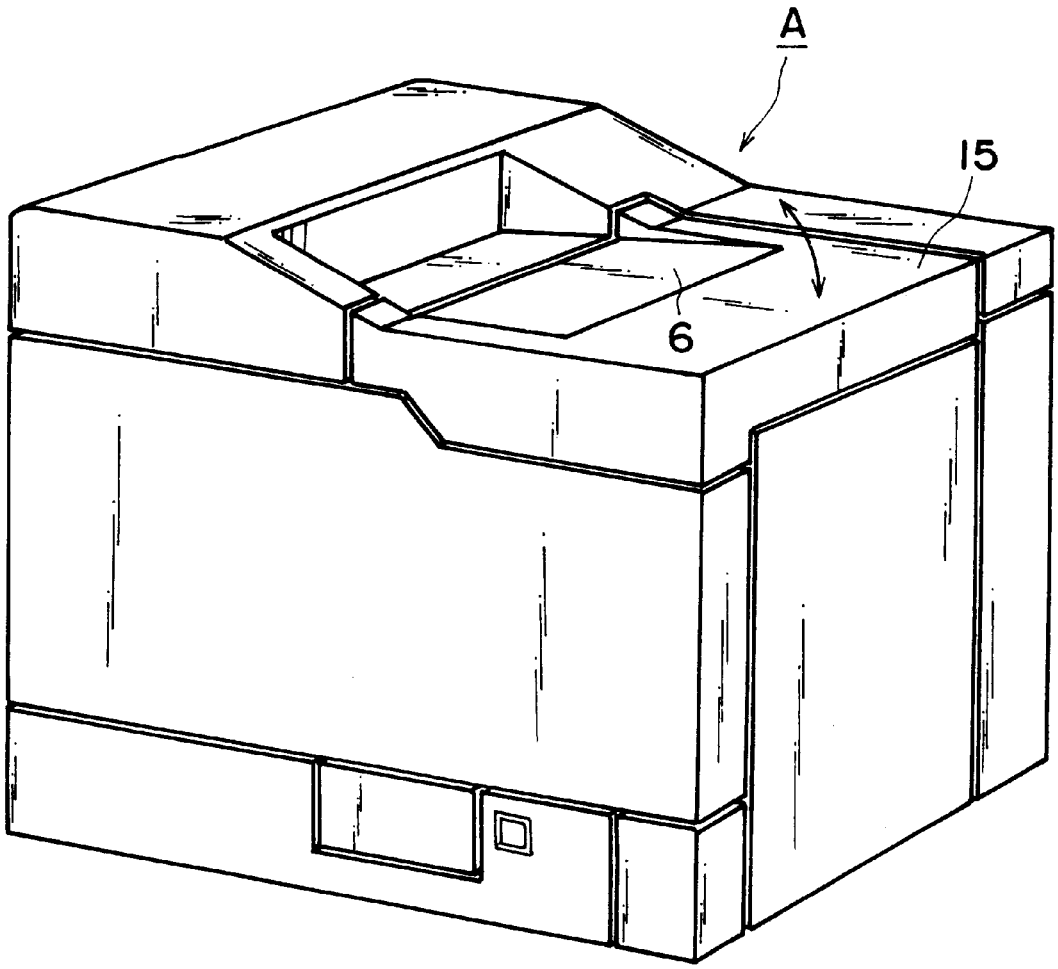
FIG. 2 is a perspective view of the apparatus illustrated in FIG. 1.
Figure 3:
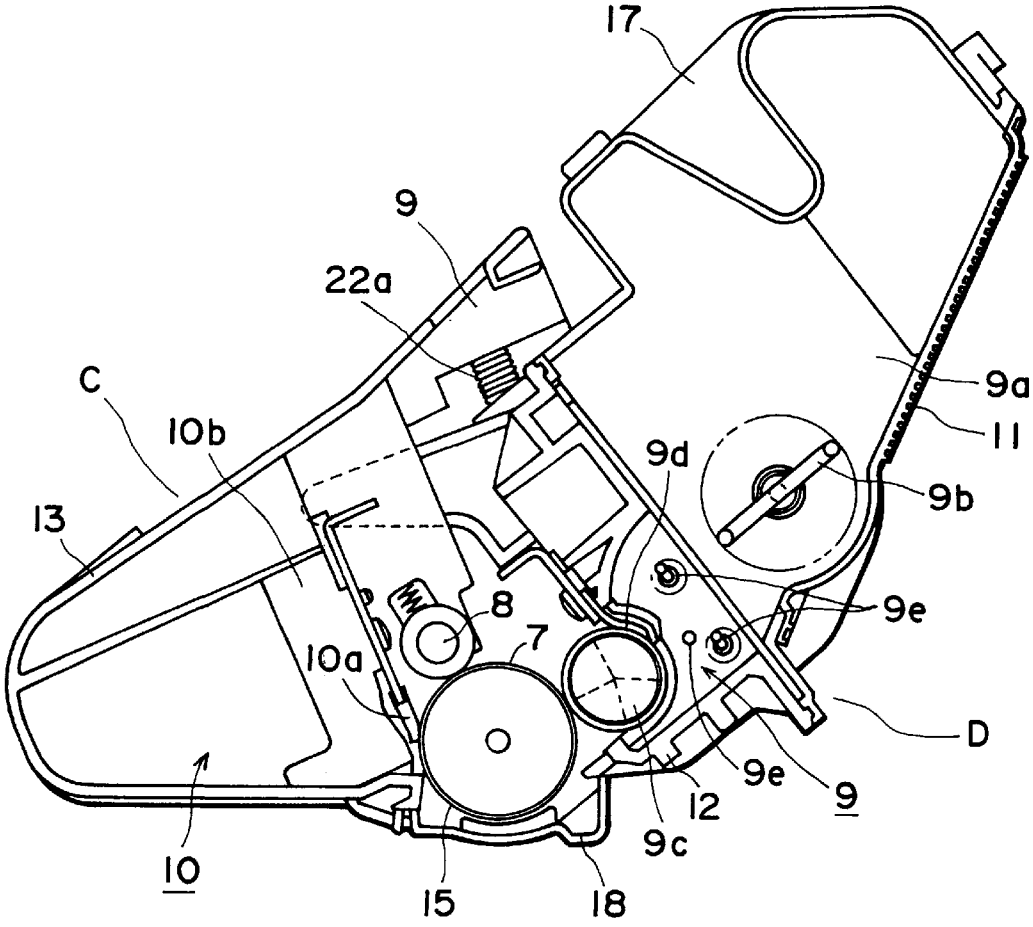
FIG. 3 is a sectional view of a process cartridge to which the first embodiment of the present invention has been applied.
Figure 4:
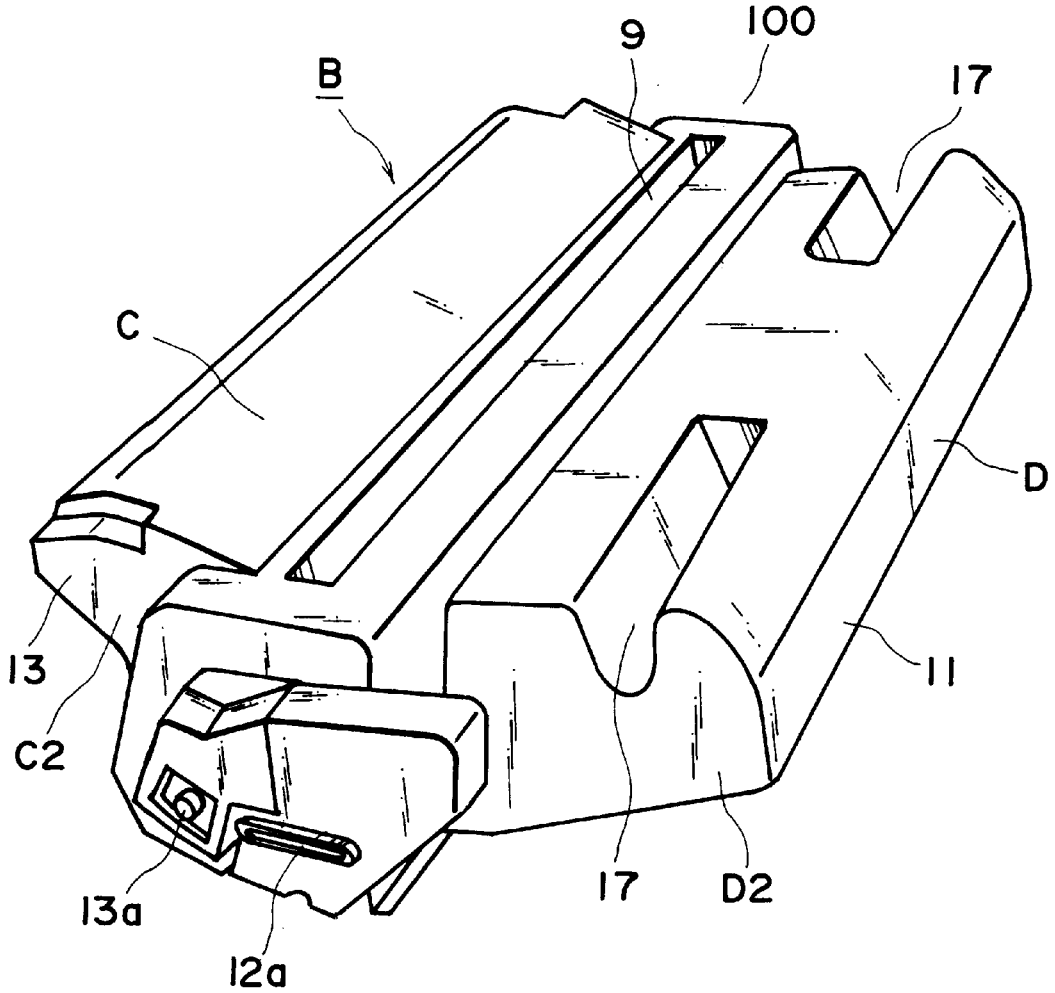
FIG. 4 is a schematic, perspective and external view of the process cartridge illustrated in FIG. 1.
Figure 5:
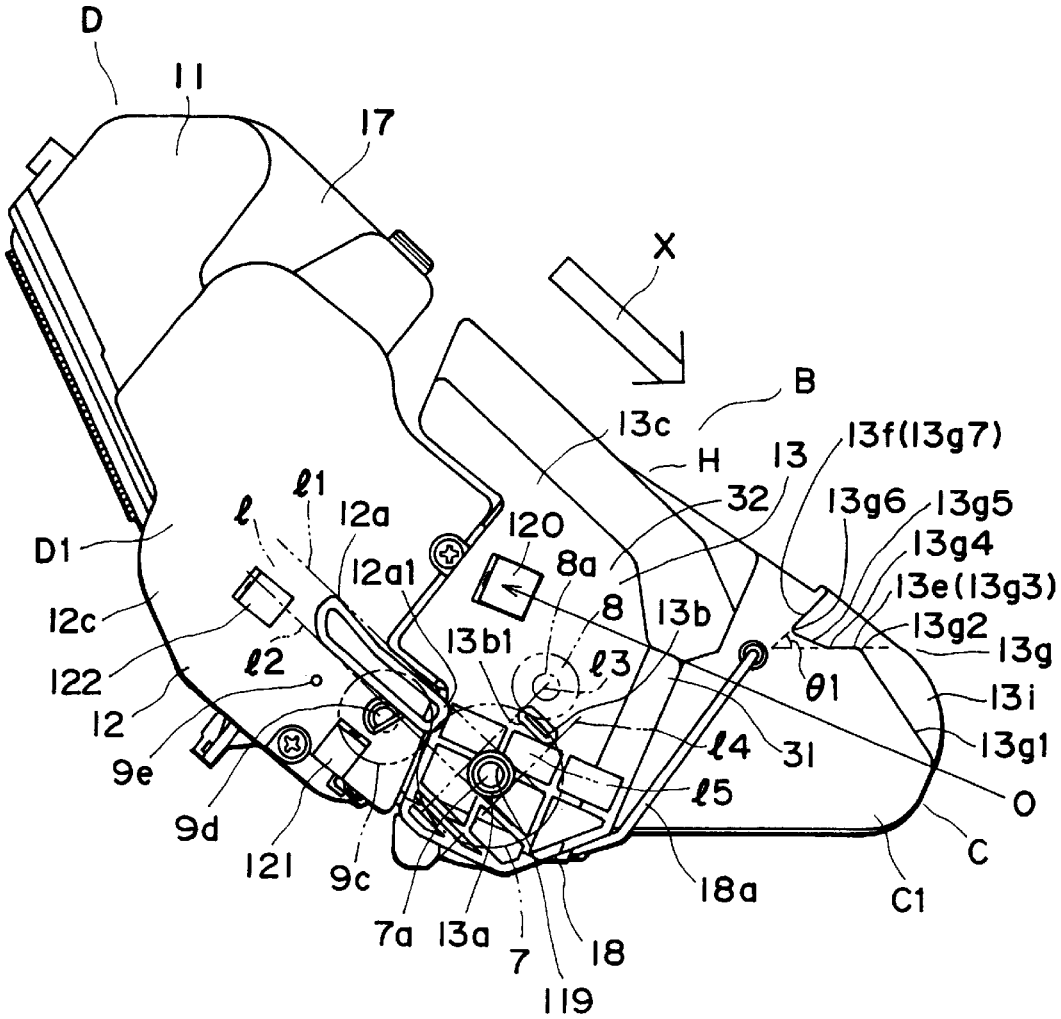
FIG. 5 is a right-hand side view of the process cartridge illustrated in FIG. 1.
Figure 6:
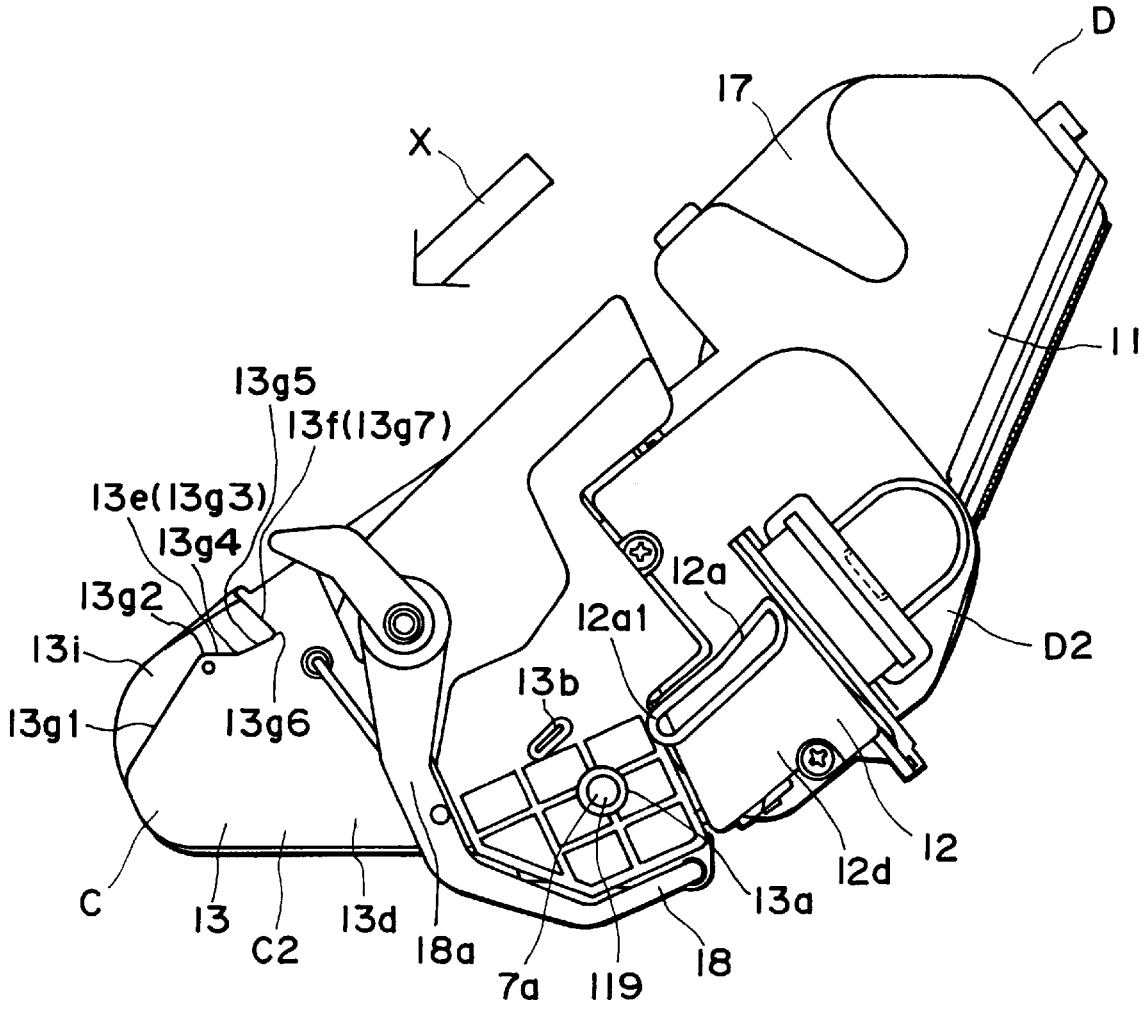
FIG. 6 is a left-hand side view of the process cartridge illustrated in FIG. 1.
Figure 7:
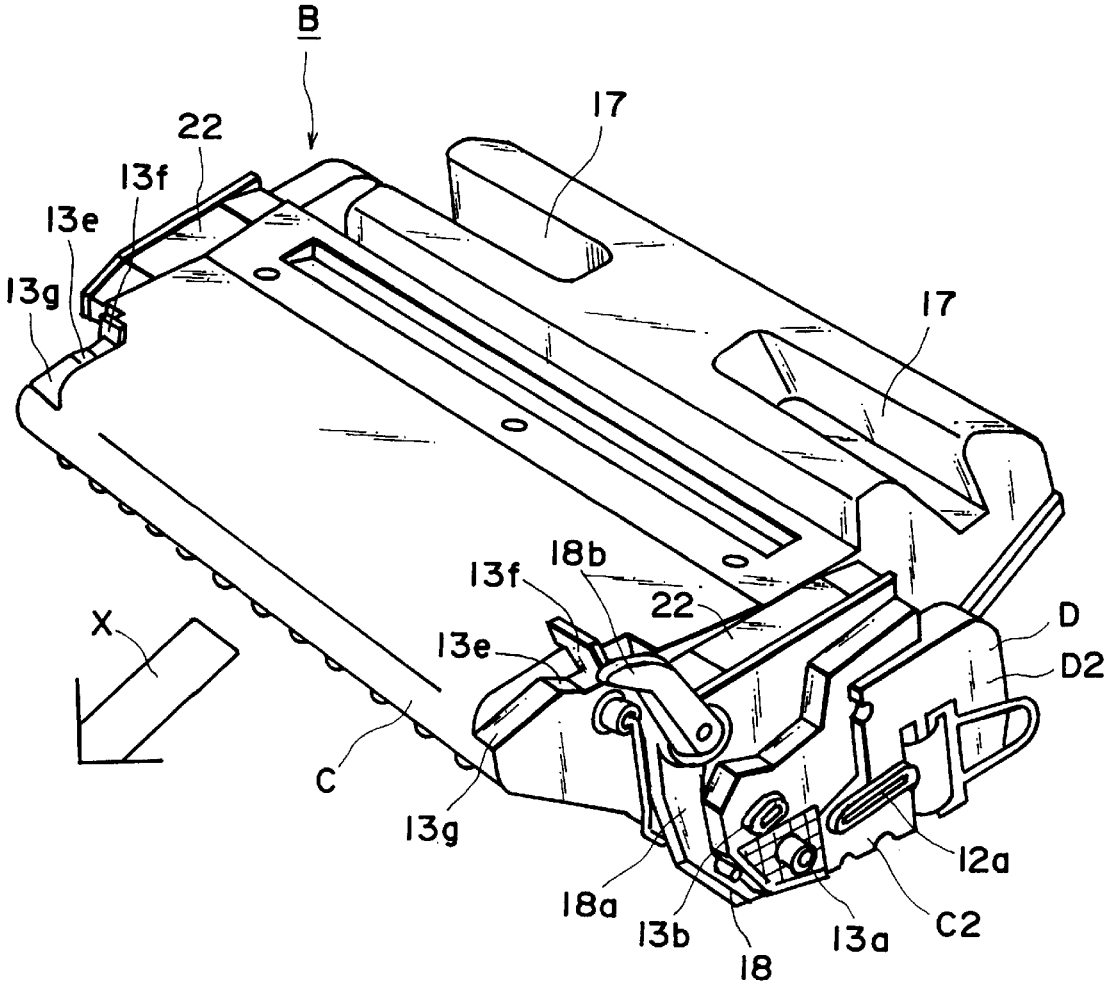
FIG. 7 is a perspective external view of the process cartridge illustrated in FIG. 1.
Figure 8:
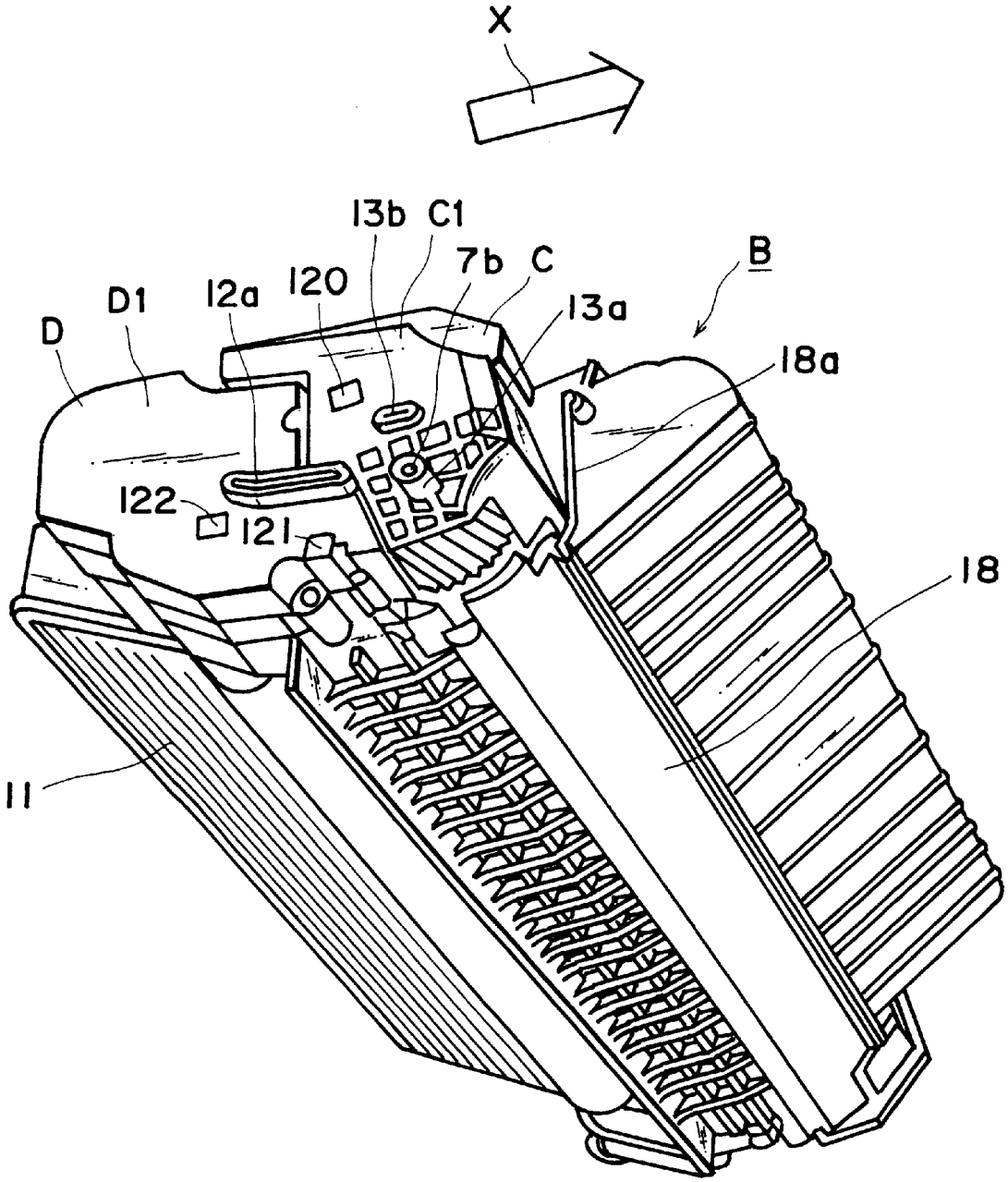
FIG. 8 is a perspective external view of the process cartridge illustrated in FIG. 1, as seen from underneath.

FIG. 1 is a sectional view of an embodiment of an electrophotographic image forming apparatus according to the present invention, and illustrates the structure thereof. FIG. 2 is a perspective external view thereof. FIGS. 3–8 are drawings of the process cartridge to which the first embodiment of the present invention has been applied, wherein FIG. 3 is a cross-sectional view; FIG. 4, a schematic, perspective and external view; FIG. 5, a right-hand side view; FIG. 6, a left-hand side view; FIG. 7, a perspective view as seen from above; and FIG. 8 is a perspective view as seen from underneath.

[Electrophotographic Image Forming Apparatus A and Process Cartridge B]

To begin with, referring to FIGS. 1 and 2, an electrophotographic image forming apparatus, to which the first embodiment of the present invention has been applied, will be described. FIG. 3 is a side view of a process cartridge B.

Referring to FIG. 1, this electrophotographic image forming apparatus A is of a type which forms an image on a recording medium through the electrophotographic image forming process. First, a toner image is formed on a drum shaped electrophotographically sensitive member (hereinafter, referred to as a photosensitive drum) as an image bearing member. Meanwhile, a sheet of recording medium 2 placed in a cassette 3*a* is conveyed, being thereby fed out, by a conveying means 3 comprising a pair of pickup rollers 3*b* and 3*c,* and a pair of registration rollers 3*d* and 3*e,* and the like, in synchronism with the toner image formation. Next, a voltage is applied to a transfer roller 4 as transferring means, whereby the toner image formed on the photosensitive drum, which a process cartridge B comprises, is transferred onto the recording medium 2. Then, the recording medium having received the toner image is delivered to a fixing means 5. This fixing means 5 comprises a driving roller 5*c* and a fixing roller 5*b* containing a heater 5*a,* and applies heat and pressure to the recording medium 2, which is passed through the fixing means 5, whereby the transferred toner image is fixed. Next, the recording medium 2 now bearing the fixed toner image is conveyed and discharged into a discharge tray 6, through a sheet-reversing path 3*j,* by a group of discharging roller pairs 3*g,* 3*h* and 3*i.* This discharge tray 6 is provided on the top surface of the apparatus A main assembly. The apparatus A also comprises a pivotable flapper 3*k* and a discharge roller pair 3*m,* and when this flapper 3*k* is operated, the recording medium 2 can be discharged without being flipped over through the discharge roller pair 3*m,* without going through the sheet-reversing path 3*j.*

In the process cartridge B, the surface of a photosensitive drum 7 as the image bearing member with a photosensitive layer 7*e* (FIG. 26) is uniformly charged by applying a voltage to a charging roller 8, which is a charging means, while the photosensitive drum 7 is rotated. Next, a laser beam carrying the image data is projected by an optical system 1 onto the photosensitive drum 7 through an exposure opening 9, whereby a latent image is formed on the photosensitive drum 7. This latent image is developed with toner by a developing means 9.

The charging roller 8 is placed in contact with the photosensitive drum 7 to charge the photosensitive drum 7, wherein this charging roller 8 is rotated by the rotation on the photosensitive drum 7. The developing means 9 develops the latent image formed on the photosensitive drum 7, by supplying the toner to the photosensitive drum 7, on the regions to be developed. The optical system 1 comprises a laser diode 1*a,* a polygon mirror 1*b,* a lens 1*c,* and a full reflection mirror 1*d.*

In this developing means 9, as a developing roller 9*c,* in which a magnet is fixed, is rotated, a layer of toner triboelectrically charged by a developing blade 9*d* is formed on the surface of the developing roller 9*c.* The toner is supplied from this toner layer to the photosensitive drum 7, on the region to be developed. As the toner is transferred onto the photosensitive drum 7 in correspondence with the latent image, the latent image is visualized. This developing blade 9*d* regulates the amount of the toner coated on the peripheral surface of the developing roller 9*c.* Also, a stirring member 9*e* for circulating the toner is rotatively mounted adjacent to the developing roller 9*c.*

Next, a voltage with a polarity opposite to that of the toner image is applied to the transfer roller 4, whereby the toner image on the photosensitive drum 7 is transferred onto the recording medium 2. Then, the residual toner on the photosensitive drum 7 is removed by a cleaning means 10. The cleaning means 10 comprises an elastic cleaning blade 10*a,* and the toner remaining on the photosensitive drum 7 is scraped off by the elastic cleaning blade 10*a* to be collected in a waste toner collector 10*b.*

The process cartridge B is formed by combining: a toner chamber portion 11 of the cartridge frame (hereinafter toner chamber frame), which constitutes a portion of the toner container 11*a* for storing the toner; a developing chamber portion 12 of the frame (hereinafter, developing chamber frame), which contains the developing means such as the developing roller 9*c;* and a cleaning means portion 13 of the frame (hereinafter, cleaning means frame), which comprises the photosensitive drum 7, cleaning blade 10*a,* and the like. This process cartridge B is removably installed in the apparatus A main assembly.

The process cartridge B is provided with an exposure opening 9, which allows the light beam carrying the image data to be irradiated onto the photosensitive drum 7, and a transfer opening 15, which allows the photosensitive drum 7 to face directly the recording medium 2.

Next, the structure of the housing of an embodiment of the process cartridge B according to the present invention will be described. This process cartridge B in accordance with the present invention is assembled in the following manner. First, the toner chamber frame 11 and developing chamber frame 12 are joined. Then, the cleaning means frame 13 is rotatively attached to the structure formed by joining the preceding two frame portions, thereby completing a cartridge housing. Next, the aforementioned photosensitive drum 7, charging roller 8, developing means 9, cleaning means 10 and the like are disposed within the housing to complete the process cartridge B. The process cartridge B is removably installed in a cartridge installing means provided within the apparatus main assembly 14.

[Structure of Housing of Process Cartridge B]

The housing of the process cartridge B according to the present invention is constructed by joining the toner chamber frame 11, developing chamber frame 12, and cleaning means frame 13, and its structure will be described below.

Figure 9A:
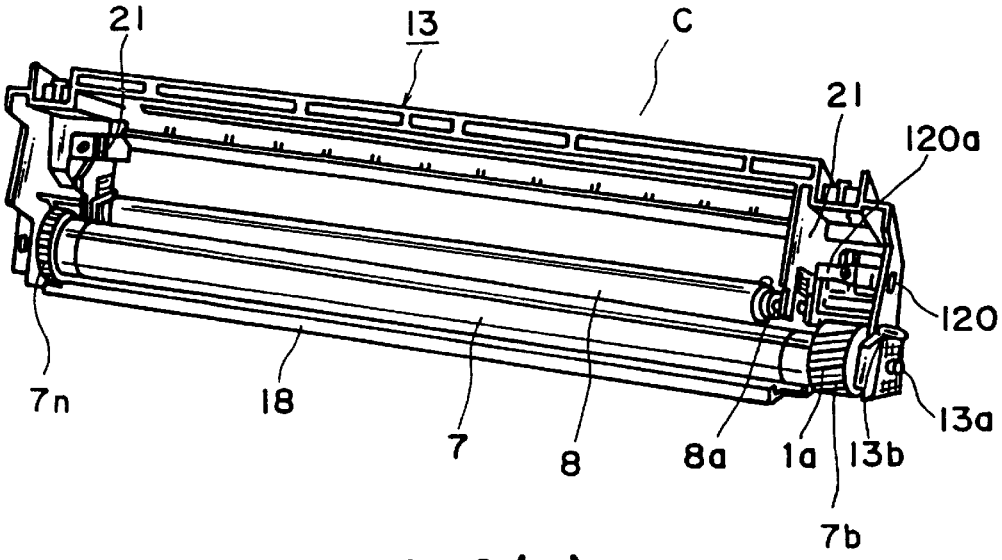
FIG. 9(*a*) is a perspective external view of the cleaning unit of the process cartridge illustrated in FIG. 1, and FIG. 9(*b*) is a perspective external view of the developing unit of the process cartridge illustrated in FIG. 1.
Figure 9B:
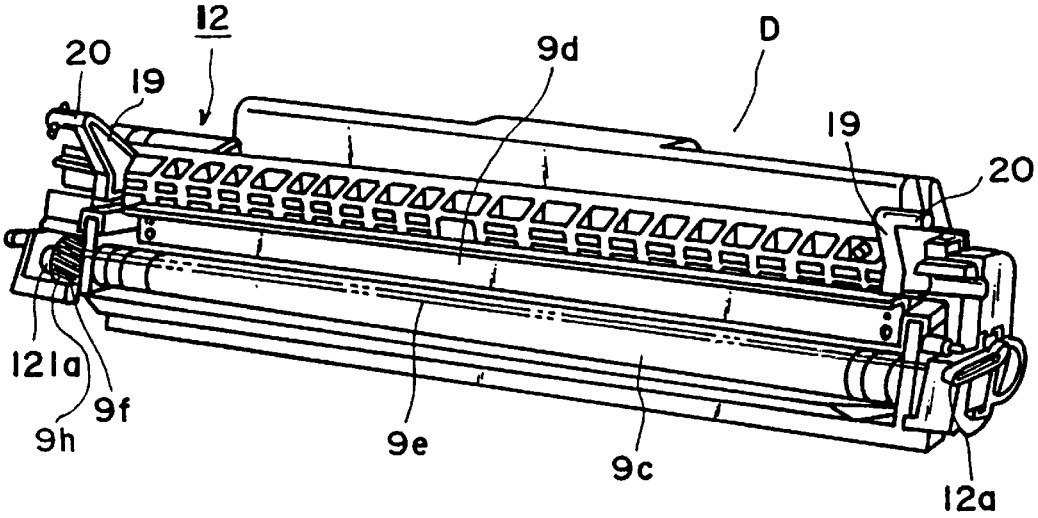

Referring to FIGS. 3 and 9, the toner chamber frame 11 comprises a toner storing container portion 9*a,* in which the toner sending member 9*b* is mounted. The developing roller 9*c* and developing blade 9*d* are mounted on the developing chamber frame 12, and the stirring member 9*e,* which circulates the toner within the developing chamber, is rotatively mounted adjacent to the developing roller 9*c.* The aforementioned toner chamber frame 11 and developing chamber frame 12 are melt-welded (by the ultrasonic welding in this embodiment) to form a developing unit D as an integral second frame member (refer to FIG. 9(*b*)).

The photosensitive drum 7, charging roller 8, and cleaning means 11 are mounted on the cleaning means frame 13. Further, a drum shutter member 18, which covers and protects the photosensitive drum 7 when the process cartridge B is out of the apparatus A main assembly, is attached to the cleaning means portion 13 of the frame to form a cleaning unit C as the first frame member (refer to FIG. 9(*a*)).

Then, the developing unit D and cleaning unit C are joined with a joining member 22 to complete the process cartridge B. More specifically, referring to FIG. 9, an axis 20 is provided at the end of an arm portion 19 formed at each of the longitudinal ends of the developing chamber portion 12 of the frame (refer to FIG. 9(*b*)). On the other hand, a recessed portion 21, in which the axis 20 is fitted to fix the positional relationship between the developing D and cleaning unit C, is provided at each of the longitudinal ends of the cleaning means portion 13 of the frame (refer to FIG. 9(*a*)). The joining member 22 is mounted on the cleaning means portion 13 of the frame by inserting the axis 20 into the recessed portion 21, whereby the developing and cleaning units D and C are joined in a manner so as to pivot relative to each other about the axis 20, thereby allowing the developing roller 9*c* to be pressed toward the photosensitive drum 7 due to the weight of the developing unit D itself. Also, the joining member 22 is provided with a compression spring 22*a,* so that the developing chamber frame 12 is pressed downward to reliably press the developing roller 9*c* toward the photosensitive drum 7. Further, a spacer ring 9*f* is provided at each of the longitudinal end portions of the developing roller 9, wherein this ring 9*f* is pressed on the photosensitive drum 7 to keep a predetermined distance (approximately 300 $\mu$m) between the photosensitive drum 7 and developing roller 9*c*.

As for the connection between the developing unit D and cleaning unit C with the use of the joining member 22, it has been disclosed in a Laid-Open PCT Patent Application No. WO92/18920 (Laid-open on Oct. 29, 1992).

[Structure of Guiding Means of Process Cartridge B]

Next, guiding means, which guides the cartridge B when the cartridge B is installed into the apparatus A main assembly or removed therefrom, will be described referring to FIGS. 4–9, wherein FIG. 5 is a right-hand side view of the cartridge B relative to the direction of an arrow mark X, in which the cartridge B is inserted into the apparatus A main assembly (right-hand side as seen from the developing unit D side), and FIG. 6 is a left-hand side view of the same.

As is evident from the drawings, the guiding means, which serves as a guide when the process cartridge B is inserted into the apparatus main assembly 14 or removed therefrom, is provided on each of the longitudinal end surfaces of the housing 100. This guiding means comprises a doweled portion 13*a* as a first guiding member, a long guide 12*a* as a second guiding member, and a short guide 13*b* as a third guiding member.

The projection or doweled portion 13*a* is a cylindrical member for rotatively supporting a drum shaft 7*a,* which supports the photosensitive drum 7, and is provided on each of the lateral surfaces of the cleaning means frame 13. The long guide 12*a* is provided on each of the longitudinal end surfaces of the developing chamber frame 12, and bridges the surfaces of the developing chamber frame 12 and cleaning means frame 13. The short guide 13*b* is provided on each of the longitudinal end surfaces of the cleaning means frame 13, above the doweled portion 13*a*.

The long guide 12*a* extends in the direction (arrow X direction), in which the cartridge B is inserted, and its angle is set to be substantially equal to an angle at which the process cartridge B is inserted. The doweled portion 13*a* is disposed so as to fall in the path of the imaginary extension of the long guide 12*a* in the cartridge inserting direction, and the short guide 13*b* is substantially parallel to the long guide 13*a*. The doweled portion 13*a,* second guide member 12*a,* and third guide member 13*b* are also provided on the longitudinal side surface opposite to the one illustrated in FIG. 10, and their configuration and positions are the same as those shown in FIG. 10. These three guiding members project substantially the same distance from the cleaning means frame 13 and developing chamber frame 12, which are in the same plane.

Hereinafter, a more detailed description will be given.

The doweled portion 13*a* as the first guiding member is provided on each of the lateral surfaces C1 (right-hand side 13*c*) and C2 (left-hand side 13*d*) of the cleaning unit C, wherein the side C1 is the right-hand side portion 13*c* of the cleaning means frame 13, relative to the axial direction of the photosensitive drum 7, as the cartridge B is seen from the developing unit D side (as the cartridge B is seen from the downstream side of the cartridge B inserting direction). The other side C2 is the left-hand side portion of the cleaning means frame 13, relative to the axial direction of the photosensitive drum 7. This doweled portion 13*a* is a cylindrical member, which projects from each of the longitudinal end surfaces 13*c* and 13*d* of the cleaning means frame 13 in the axial direction of the photosensitive drum 7. The drum shaft 7*a* is supported by this cylindrical member 13*a,* which fits around the drum shaft 7*a*. In other words, the drum shaft 7*a* is guided by the guiding member 16*a,* which will be described later, with the cylindrical member 13*a* being interposed, and then, the position of the drum shaft 7*a* is fixed by a groove 16*a*5.

The long guide 12*a* as the second guide member is provided on each of the longitudinal end surfaces D1 (right-hand portion 12*c*) and D2 (left-hand side 12*d*) of the developing unit D, wherein one surface, D1, of the lateral portion is the right-hand portion 12*c,* relative to the axial direction of the photosensitive drum 7, of the developing chamber frame portion 12, and the other surface, D2, is the left-hand side portion 12*d,* relative to the axial direction of the photosensitive drum 7, of the developing chamber frame portion 12. The long guide 12*a* is disposed away from the cylindrical member 13*a,* being on the upstream side of the cylindrical member 13*a,* relative to the cartridge inserting direction (arrow X direction). More precisely, the long guide 12*a* is disposed within a region 1 formed between the top and bottom imaginary lines 11 and 12 (FIG. 5) extended parallel in the inserting direction and tangentially from the peripheral surface of the cylindrical member 13*a,* and this long guide 12*a* bridges between the developing chamber frame portion 12 and cleaning means frame portion 13, with its inserting end portion 12*a*1 extending over the lateral surface area of the cleaning frame portion 13 (by an approximate distance of 1 mm to 3 mm).

The short guide 13*b* as the third guiding member is provided on the lateral surfaces 13*c* and 13*d* of the cleaning unit C, above the cylindrical member 13*a*. More specifically, the short guide 13*b* is substantially directly above the cylindrical member 13*a* as seen from the cartridge inserting direction. In other words, the short guide 13*b* is disposed within the region 15 formed between two parallel lines 13 and 14, which are drawn in such a manner as to be tangent to the peripheral surface of the cylindrical member 13*a* and substantially perpendicular to the cartridge inserting direction (arrow X direction). In addition, the short guide 13*b* is substantially parallel to the long guide 13*a*.

Here, typical measurements of the guiding members will be listed.

The first guide member 13*a* is approximately 10.0 mm in diameter (tolerable range of 7.5 mm to 10.0 mm); the second guide member 12*a,* approximately 36.0 mm in length (tolerable range of 15.0 mm to 41.0 mm) and approximately 8.0 mm in width (tolerable range of 1.5 mm to 10.0 mm);

and short guide 13*b* is approximately 10.0 mm in length (tolerable range of 3.0 mm to 17.0 mm) and approximately 4.0 mm (tolerable range of 1.5 mm to 7.0 mm) in width. Further, the distance between the peripheral surface of the first guide member 13*a* and the inserting end portion 12*a*1 of the second guiding member 12*a* is approximately 9.0 mm.

The distance between the peripheral surface of the first guiding member 13*a* and the bottom end tip 13*b*1 of the third guiding member 13*b* is approximately 7.5 mm (tolerable range of 5.5 mm to 9.5 mm).

Next, a regulatory contact portion 13*e* and a disengagement contact portion 13*f,* which are provided on the top surface 13*d* of the cleaning unit C, will be described. Here, the top surface means such a portion of the cleaning unit C surface that is going to face upward when the process cartridge B is installed into the apparatus A main assembly. In this embodiment, it is the top surface 13*i* of the cleaning unit C.

The regulatory contact portion 13*e* and disengagement contact portion 13*f* are provided on each of the lateral end portions 13*c* and 13*d* of this surface 13*i.* This regulatory contact 13*e* fixes the position of the process cartridge B in the apparatus A main assembly. More specifically, when the process cartridge B is inserted into the apparatus A main assembly, the contact 13*e* comes in contact with a fixing member 25 provided on the apparatus A main assembly (FIGS. 10–17), whereby the position of the process cartridge B is regulated. The disengagement contact portion 13*f* displays its function when the process cartridge B is removed from the apparatus A main assembly. More specifically, when the process cartridge B is taken out of the apparatus A main assembly, it comes in contact with the fixing member 25 to permit a moment to function to smoothly remove the cartridge B. The steps for installing or removing the process cartridge B will be described later with reference to FIGS. 10–17.

Describing in more detail, a recessed portion 13*g* is provided on the cleaning unit C, on the top surface 13*i* of the cleaning unit C, at each of the lateral edges relative to the cartridge inserting direction. This recess portion 13*g* is provided with: the first slanted surface 13*g*1, which extends upward toward the rear from the leading end of the cartridge B relative to the inserting direction (arrow X direction); the second slanted surface 13*g*3, which extends downward toward the rear from the top end 13*g*2 of the slanted surface 13*g*3; and the fourth slanted surface 13*g*5, which extends further downward toward the rear from the bottom end 13*g*4 of the slanted surface 13*g*3. At the bottom end 13*g*6 of the slanted surface 13*g*5, a wall 13*g*7 is provided. The second slanted surface 13*g*3 corresponds to the regulatory contact portion 13*e,* and the wall 13*g*7 corresponds to the disengagement contact portion 13*f.*

Here, the typical measurements of the portions described above will be listed.

The regulatory contact portion 13*e* is angled by 0 degrees relative to the horizontal direction l of the cartridge B in the apparatus A main assembly, and is approximately 6.0 mm in length (tolerable range of 4.5 mm to 8.0 mm). The disengagement contact portion 13*f* is slanted by θ1 (approximately 45 degrees) relative to the horizontal direction l, and is approximately 10.0 mm in length (tolerable range of 8.5 mm to 15.0 mm).

Next, the steps for installing the process cartridge B into the apparatus A main assembly, or removing it therefrom, will be described with reference to FIGS. 10–19.

Let it be assumed that the process cartridge B structured as described above can be installed into the cartridge accommodating means provided within the apparatus A main assembly, and can be removed therefrom.

Figure 17:
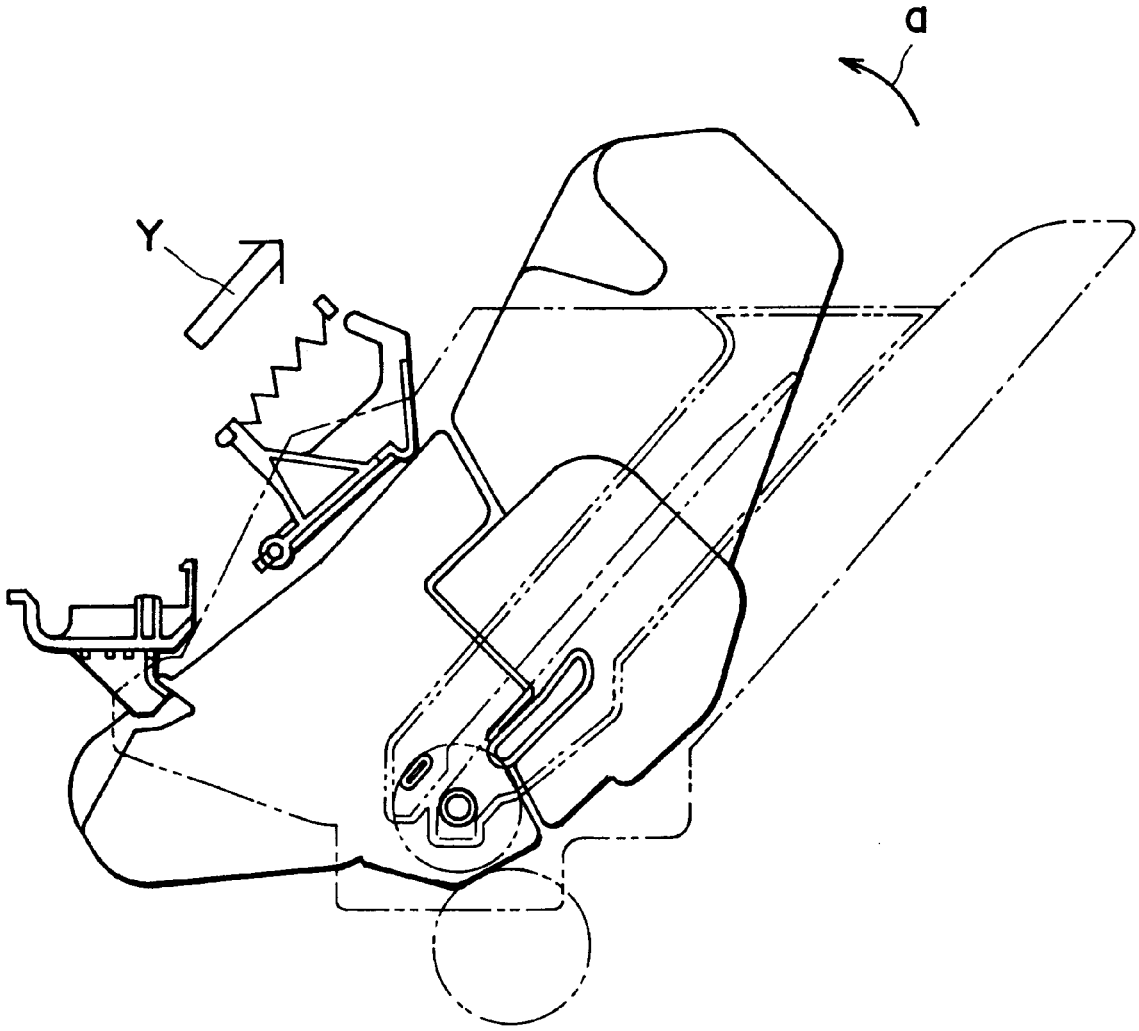
Figure 18:
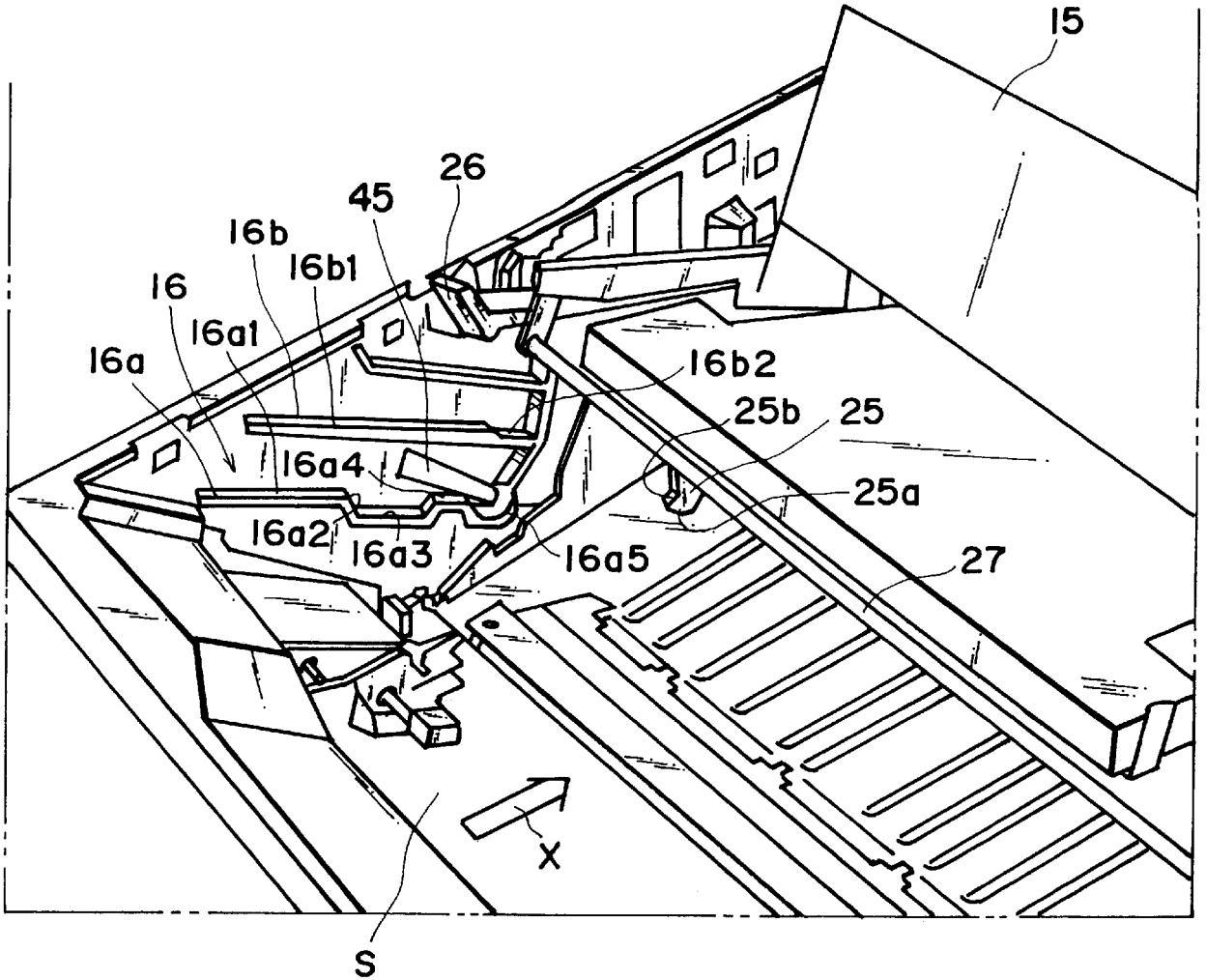
FIG. 18 is a perspective view of a portion of the interior of the apparatus main assembly.
Figure 19A:
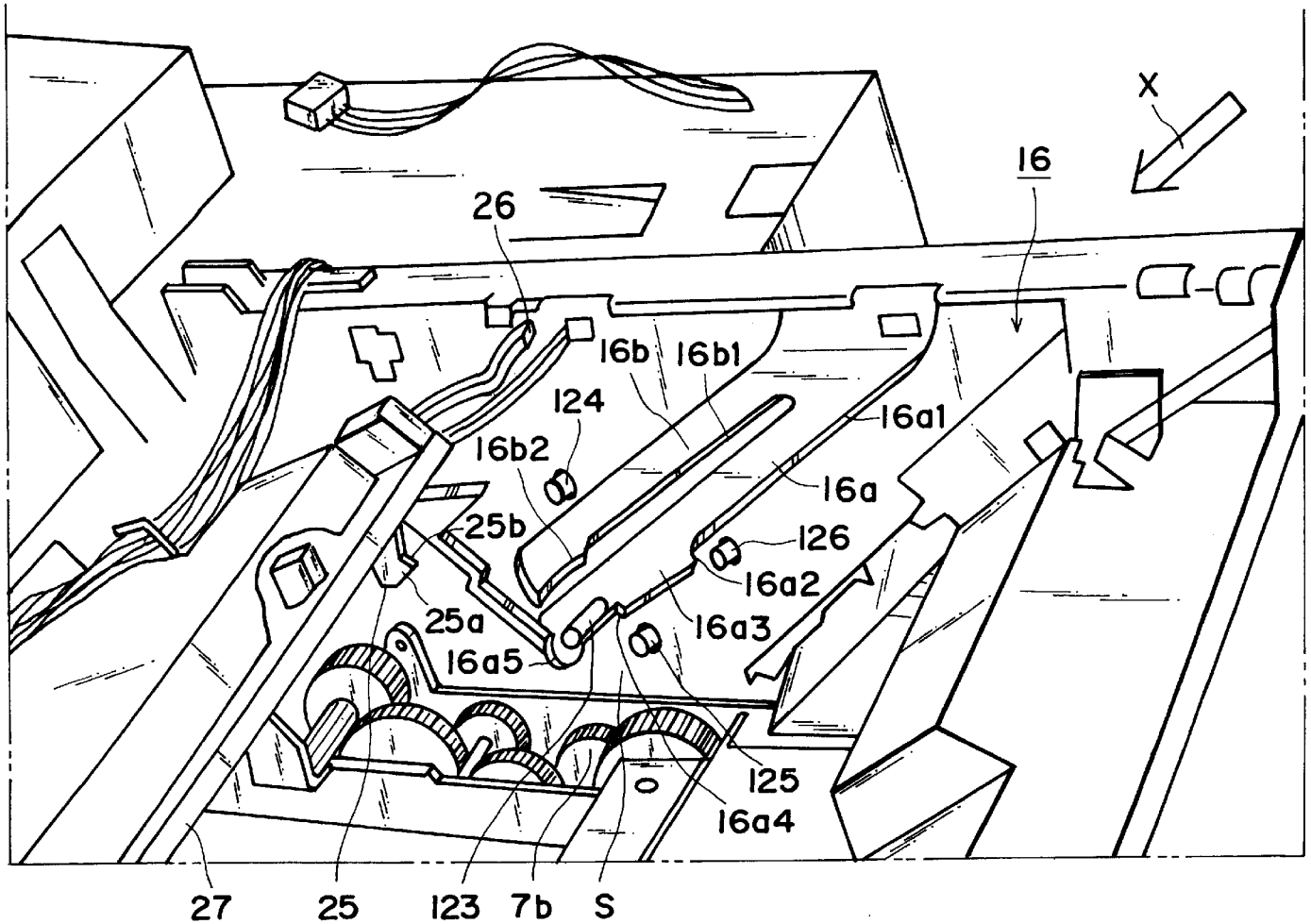
FIG. 19(*a*) is a perspective view of a different portion of the interior of the apparatus main assembly, and FIG. 19(*b*) is a side view of another interior portion of the apparatus main assembly.
Figure 19B:
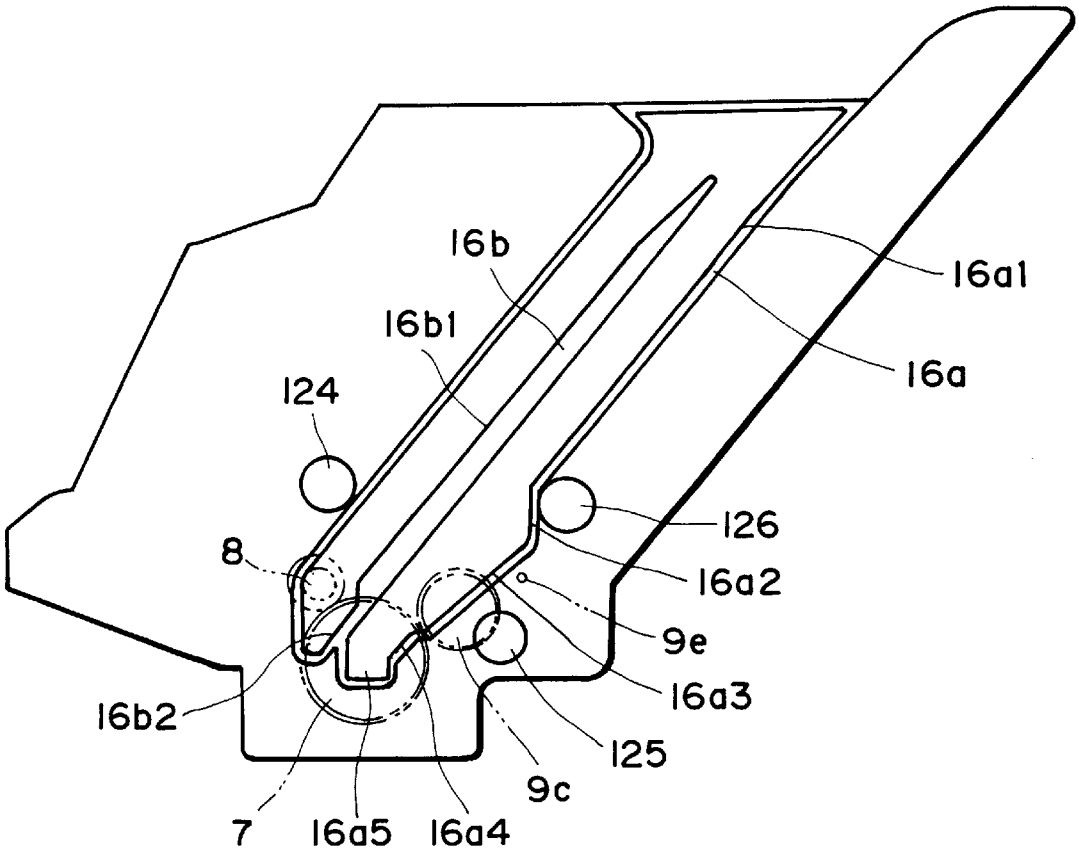

Referring to FIGS. 18 and 19, as an operator opens a pivotal cover 15, a cartridge accommodating space S, and left and right cartridge installation guides 16, which are mounted on the corresponding sides of the apparatus A main assembly, are exposed. Each of the cartridge installation guides 16 comprises a pair of guide portions of its own, that is, a first guide portion 16*a* and a second guide portion 16*b,* which correspond to the same on the opposite side. The installation of the process cartridge B into the apparatus A main assembly is accomplished by inserting the process cartridge B along the guide portions 16*a* and 16*b* and closing the cover 15. As for the inserting direction of the cartridge B, it is a direction which intersects with the axial line of the photosensitive drum 7; more specifically, such a direction that is substantially perpendicular to the axial line of the photosensitive drum 7 as illustrated in FIGS. 10–17. In this case, the cleaning unit C side is the leading side and the developing unit D side is the tailing side.

A recessed portion 17 is provided on the cartridge B, which makes it easier for an operator to hold it during its installation or removal (see FIG. 3).

Further, the process cartridge B comprises a drum shutter 18 (see FIG. 3), the movement of which is linked to the movement of the cartridge B during its installation or removal. When the cartridge B is removed from the apparatus A main assembly, the shutter 18 is closed to protect the portion of the photosensitive drum 7 which faces the transfer opening. The shutter 18 is supported by an arm 18*a,* and the pivotal cover 15 pivots about a pivotal point 15*d* (FIG. 1).

The first guide portion 16*a* is the bottom portion of the guide member 16, and guides the long guide 12*a* and cylindrical member 13*a* provided on the process cartridge B side. This first guide portion 16*a* comprises a main guide portion 16*a*1, a stepped portion 16*a*2, a recessed portion 16*a*3, an auxiliary guide portion 16*a*4, and a positioning groove 16*a*5, which are disposed in this order from the upstream side toward the downstream relative to the inserting direction. The main guide portion 16*a*1 guides the long guide 12*a* and cylindrical member 13*a*. The auxiliary guide portion 16*a*4 guides the cylindrical member 13*a* into the positioning groove 16*a*5. The positioning groove 16*a*5 is where the cylindrical member 13*a* is fitted to regulate the position of the cartridge B in the apparatus A main assembly. The second guide portion 16*b* is the upper portion of the guide member 16, and comprises a slanted surface 16*b*1 and a recess 16*b*2, which are disposed in this order from the upstream side toward the downstream relative to the inserting direction.

Further, in the cartridge accommodating space S of the apparatus A main assembly, a fixed member 25 (member for regulating the rotation) is provided on the left and right sides. It is fixed to a stay 27. This fixed member 25 comes in contact with the aforementioned regulatory contact portion 13*e* to regulate the clockwise rotation of the cartridge B. More specifically, the cartridge B is accurately positioned in the apparatus A main assembly as the cylindrical member 13*a* fits into the groove 16*a*5 and the regulatory contact 13*e* comes in contact with the fixed member 25. Further, when the cartridge B is taken out, the fixed member 25 comes in contact with the disengagement contact portion 13*f* to facilitate the smooth removal of the cartridge B.

Further, in the cartridge accommodating space S, a pressing member 26 is disposed on the left and right sides. This pressing member 26 pressed in the clockwise direction by the elastic force of a coil spring 26*a* is rotatable about a fulcrum 26*b,* and elastically presses the top surface of the cartridge B, whereby the cartridge B is prevented from being vibrated when the apparatus A is subjected to vibration or the like.

Figure 10:
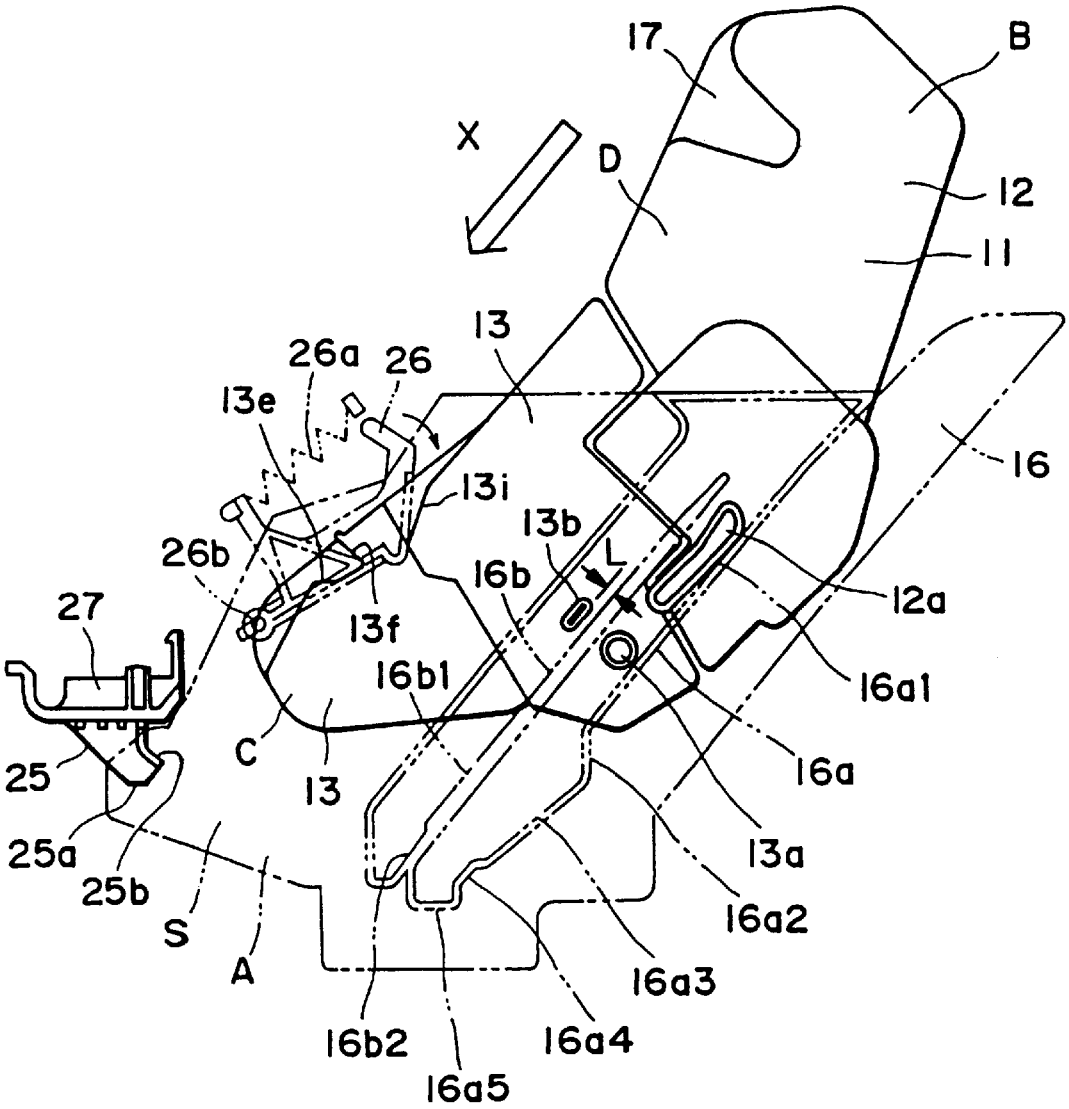
FIGS. 10–17 are side views, which depict steps for installing the process cartridge illustrated in FIG. 1 into the main assembly of the image forming apparatus, or removing it therefrom.

Next, the relationship between the installation guide 16 provided on the apparatus A main assembly and the guide members 12*a,* 13*a* and 13*b* provided on the cartridge B, during the installation or removal of the cartridge B, will be described with reference to the drawings. FIGS. 10–15 are schematic drawings, which depict the steps for installing the process cartridge B from the beginning of the cartridge installation to the moment when the process cartridge B is finally positioned in a predetermined location. In FIGS. 10 and 15, the full side view of the process cartridge B is depicted with a solid line, and the installation guide member of the apparatus main assembly is depicted with a double dot chain line (imaginary line). In FIGS. 11–14, which depict intermediary steps of the cartridge installation, only the guide members of the process cartridge B are depicted with the solid line, and the other portions are depicted with the double dot chain lines.

First, referring to FIG. 10, at the beginning of the cartridge B installation into the apparatus A main assembly, the cylindrical member 13*a* and long guide 12*a* of the cartridge B are guided by the guide portion 16*a* in such a manner as to slide thereon. At this moment, the short guide 13*b* is not guided by the guide portion 16*a,* being away from it by a predetermined distance L (in this embodiment, approximately 2.0 mm to 4.0 mm).

Also at this moment, the pressing member 26 rotates upward following the slanted surface 13*i* provided on the top surface of the cartridge B, so that it does not interfere with the cartridge installation. As the cartridge B is being further inserted, the pressing member 26 keeps on sliding on the top surface of the cartridge B, checking thereby the upward movement of the cartridge B. Even after the cartridge B has been installed in the apparatus A, the pressing member 26 keeps on pressing on the top surface of the cartridge B as long as the cartridge B is in the apparatus A.

Figure 11:
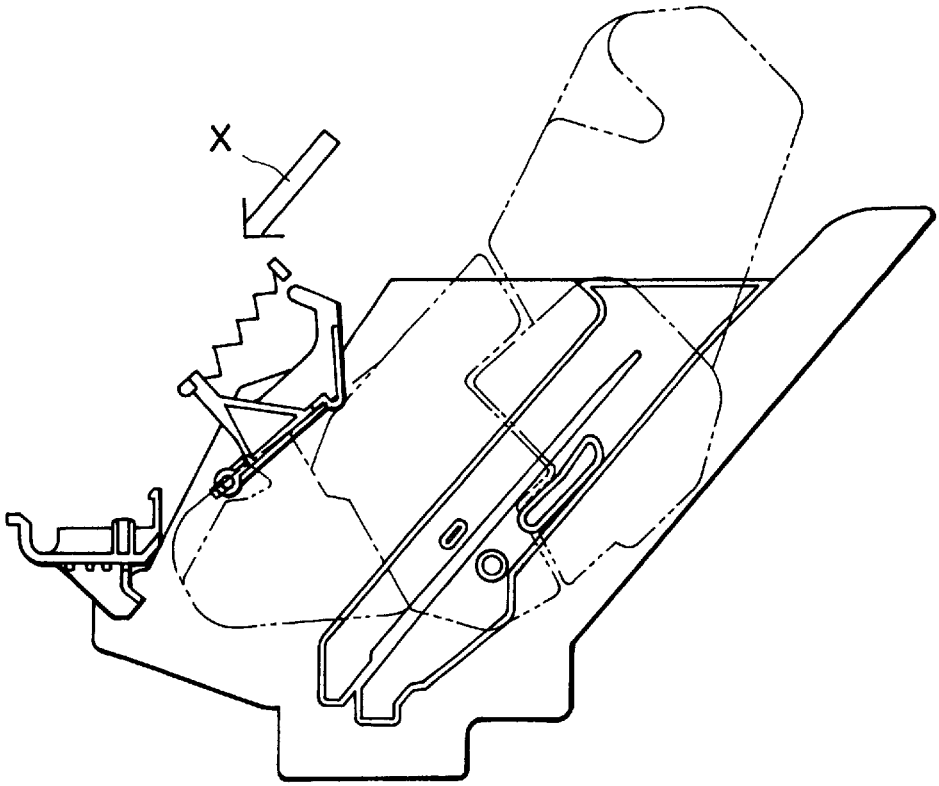

Next, when the process cartridge B has been further inserted and is in the state depicted in FIG. 11, the cylindrical member 13*a* is ready to pass the stepped portion 16*a*2 provided on the first installation guide portion 16*a* and to move onto the recess portion 16*a*3 provided also on the first installation guide portion 16*a*. This recessed portion 16*a*3 of the guide portion 16*a* is to let go the long guide 12*a* when the process cartridge B is inserted to a predetermined point (FIG. 15), and its depth m (in this embodiment, approximately 4.0 mm to 8.0 mm) is set to be larger than the aforementioned distance l (1<m). It should be noted that at this moment, the short guide 13*b* is not in contact with the second guide portion 16*b* (16*b*1).

Figure 12:
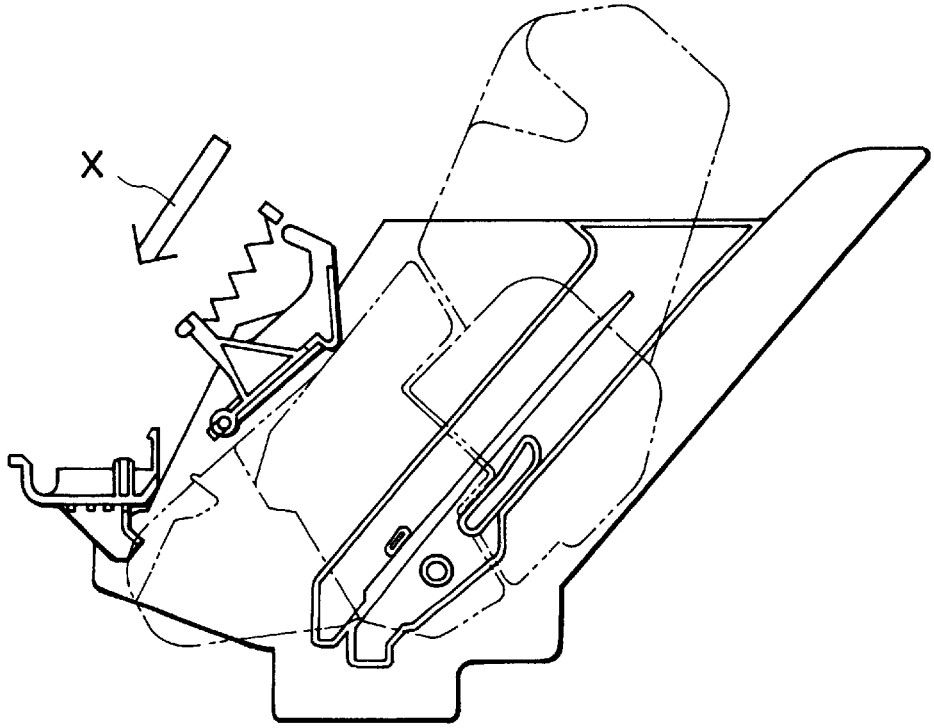

Next, as the process cartridge B is further inserted until the state depicted in FIG. 12 is realized, the short guide 13*b* makes contact with the guide portion 16*b* before the cylindrical member 13*a* of the cartridge B reaches the bottom of the recessed portion 16*a*3. In other words, at this time, both the long and short guides 12*a* and 13*b* serve as the insertion guide, whereby the shock, which might be imparted on the cartridge B by the stepped portion or the like, is reduced.

Figure 13:
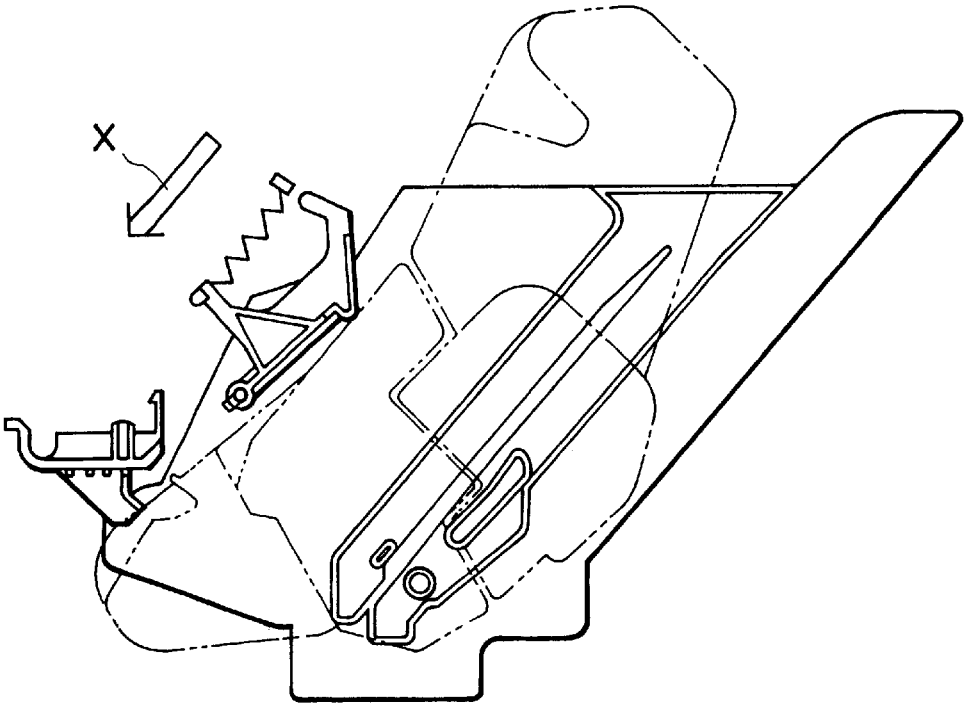

As the process cartridge B is further inserted, the state illustrated in FIG. 13 is realized. In this state, the trailing end of the long guide 12*a* of the process cartridge B is at the edge of the recessed portion 16*a*3 of the first guide portion 16*a,* and the cylindrical member 13*a* of the process cartridge B is in contact with the auxiliary guide portion 16*a*4, being ready to follow the guide portion 16*a*4. Next, the cylindrical member 13*a* and short guide 13*b* of the process cartridge B are guided by the first guide portion 16*a* and second guide portion 16*b,* respectively (FIG. 14).

Figure 14:
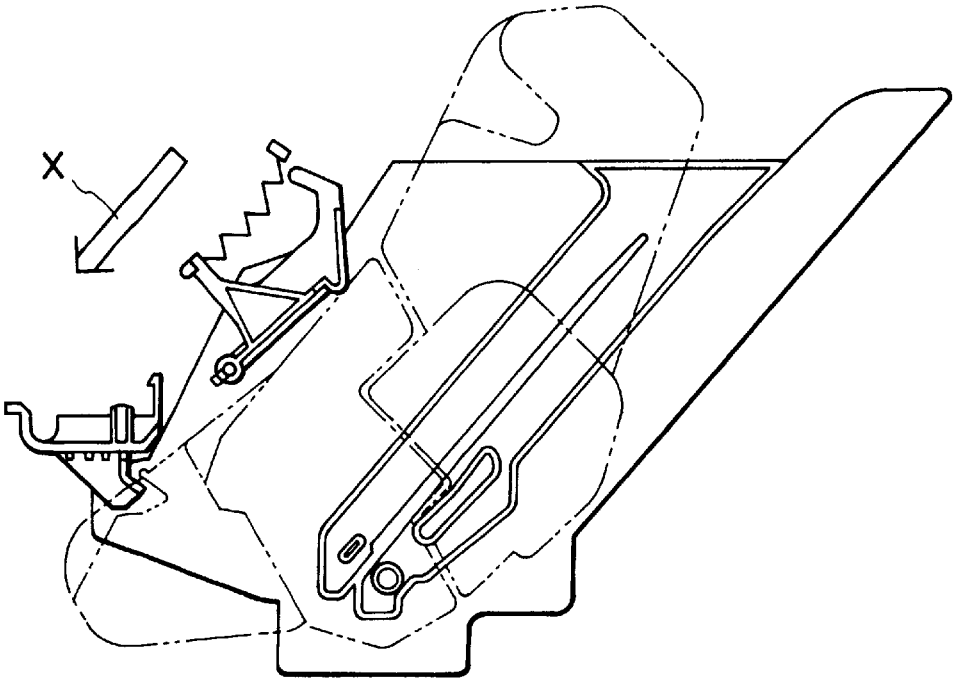
Figure 15:
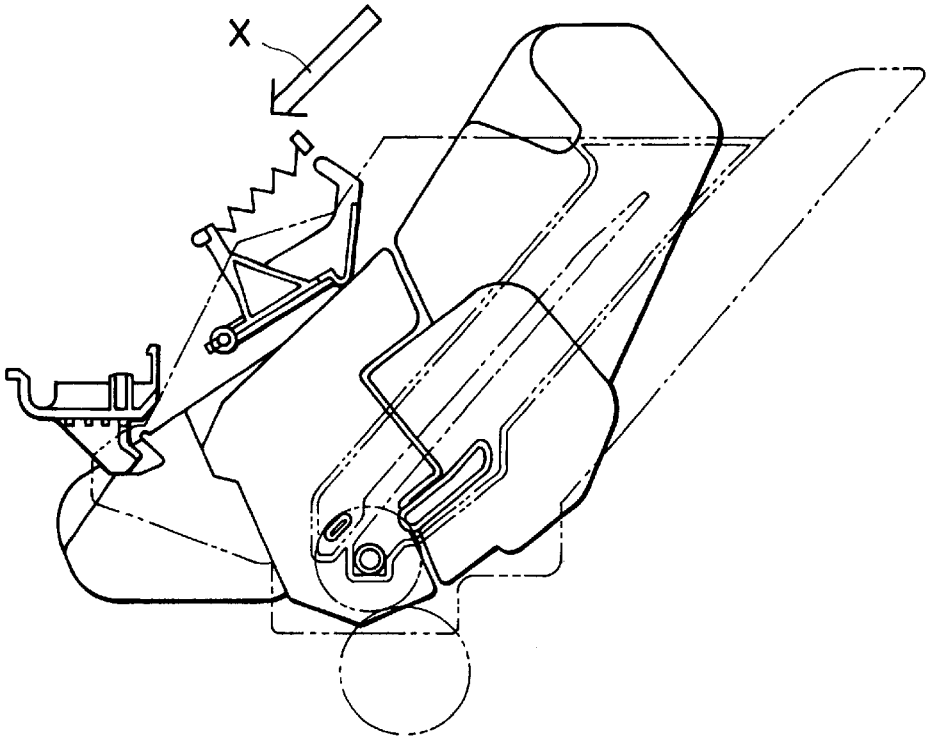

Next, as the cartridge B is further inserted and the state illustrated in FIG. 14 is realized, the short guide 13*b* comes to the recessed portion 16*b*2 of the second guide portion 16*b*. For a short period in which this short guide 13*b* drops into the recessed portion 16*b*2, only the cylindrical member 13*a* is in contact with the apparatus A main assembly, at the auxiliary guide portion 16*a*4; therefore, the process cartridge B slightly rotates in the counterclockwise direction, and lastly, the cylindrical member 13*a* drops into the groove 16*a*5 of the guide portion 16*a* (FIG. 15). At substantially the same time, the regulatory contact portion 13*c* provided on the cleaning means frame portion 13 comes in contact with the rotation regulating portion 25*a* (FIG. 15) of the fixed member 25 fixed to the apparatus A main assembly. As a result, the overall position and orientation of the process cartridge B within the apparatus A is fixed. In this state, the position of the process cartridge B is fixed by a single point, that is, the center (cylindrical member 13*a*) of the process cartridge B, and the other guides (long and short guides 12*a* and 13*b*) are not in contact with any portion of the installation guide member 16 of the apparatus A main assembly; therefore, the position of the cartridge B is accurately fixed.

The positional relationship between the regulatory contact portion 13*e* and rotation regulating portion 25*a* is such that the moment, which is generated on the process cartridge B as the process cartridge B is driven, is received by the contact between regulatory contact portion 13*e* and rotation regulating portion 25*a.* The distance between the regulatory contact portion 13*e* and the center of the cylindrical member 13*a,* and the distance between the rotation regulating portion 25*a* and the center of the cylindrical member 13*a* are longer than the distance between the long guide 12*a* and the center of the cylindrical member 13*a,* and the distance between the short guide 13*b* and center of the cylindrical member 13*a*. Therefore, the orientation of the process cartridge B remains more stable when the process cartridge B is driven.

In a state shown in FIG. 15, a helical gear 7*b* provided on the photosensitive drum 7, at one of the axial ends, engages with a driving helical gear 28 provided on the apparatus A side. Thus, the driving force is transmitted from the apparatus A main assembly to the photosensitive drum by way of the gears 28 and 7*b,* wherein as the driving force is transmitted from the gear 28 to gear 7*b,* the cartridge B is subjected to a force that works in the clockwise direction. However, the movement generated on the cartridge B is regulated by the contact portion 13*e*.

The pressing member 26 presses down the process cartridge B from above. Therefore, even if the cylindrical member 13*a* fails to drop into the groove 16*a*5 of the main A assembly, a moment is generated about the contact point between the rotation regulating portion 25*a* and contact portion 13*e,* whereby the cylindrical member 13*a* is caused to drop into the groove 16*a*5.

Next, referring to FIGS. 16 and 17, the steps for taking the process cartridge B out of the apparatus A will be described. In the drawing, the direction indicated by an arrow Y is the direction in which the process cartridge B is removed.

Figure 16:
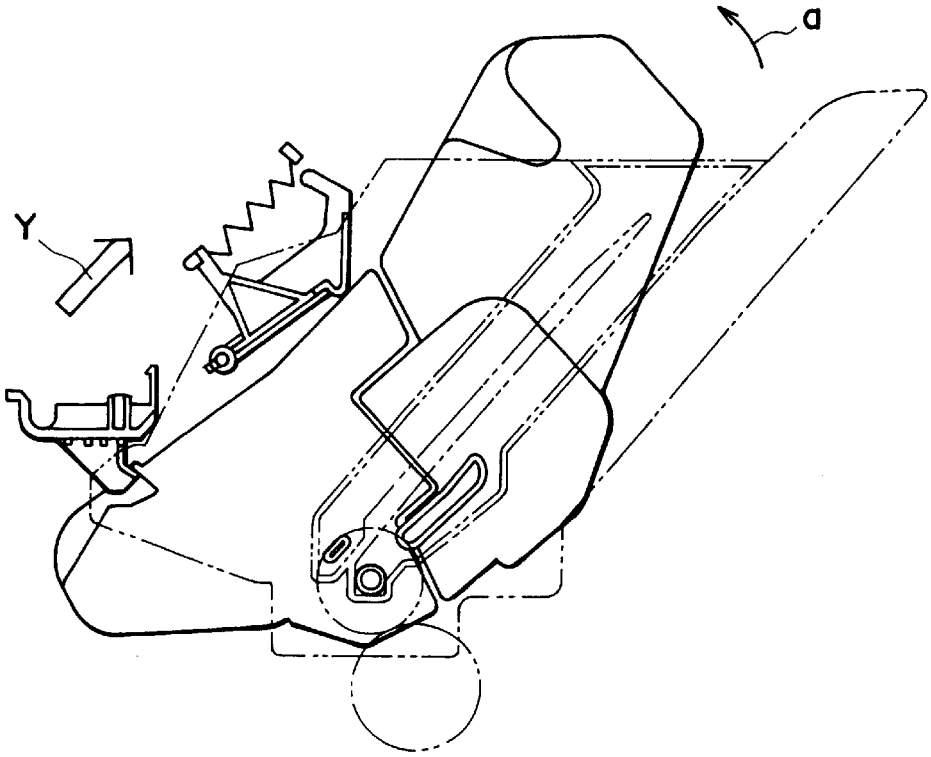

Referring to FIG. 16, when the process cartridge B is to be removed from the apparatus A, the operator grabs a handle portion 17 (to provide the handle, recessed portions, are formed on the cartridge B) and lifts the cartridge B by the handle portion 17 (direction of an arrow a), whereby the process cartridge B is rotated counterclockwise about the cylindrical member 13*a*. As a result, the regulatory contact portion 13*f* of the process cartridge B makes contact with the disengagement contact portion 25*b* of the fixed member 25 provided on the apparatus A main assembly. As the process cartridge B is further lifted, it is rotated about the contact point D between the regulatory contact portion 13*f* and disengagement contact portion 25*b*. As a result, the cylindrical member 13*a* is lifted out of the groove 16*a*5. At this moment, the engagement between the drum gear 7*b* and driving gear 28 is broken. In this state, the process cartridge B can be pulled straight out of the apparatus A, following the steps depicted in FIGS. 14, 13, 12, 11 and 10 in that order. As will be understood, the recessed portions are advantageous to facilitate the grabbing action.

As described above, according to this embodiment, the long guide as the second guide member is extended in the cartridge inserting direction in such a manner as to bridge the lateral surfaces of the developing unit D and cleaning unit C; therefore, the process cartridge is prevented from wobbling during the installation or removal. As a result, the cartridge installation becomes more reliable, which improves the operational efficiency.

The guiding means, which serves as the guide when the process cartridge is inserted into the apparatus main assembly or removed therefrom, is constituted of three guide members: cylindrical member 13*a,* long guide 12*a,* and short guide 13*b,* and the process cartridge B is guided by at least two guides during its installation or removal; therefore, even if there is a stepped portion or the like on the installation guide members of the apparatus main assembly, the shock, to which the process cartridge might be subjected, is cushioned.

The position of the process cartridge is fixed by the rotation regulating portion 25*a* oriented to control the moment, which is generated on the cartridge as the cartridge is driven, and the cylindrical member 13*a,* whereas the other guides (long and short guides 12*a* and 13*b*) remain in non-contact with the guide members of the apparatus main assembly; therefore, the orientation of the process cartridge B remains more stable while the image forming apparatus is driven (during the image formation).

As for the guiding means for installing or removing the cartridge, the embodiment described above exemplifies a guiding means comprising three guide members positioned at different locations. However, the present invention is not limited to this example, but instead, it may be a guiding means comprising at least a cylindrical member as the first guide member, and a long guide as the second guide member, or a guiding means comprising an additional guide member or guide members besides the three mentioned above. Such an arrangement can also stabilize the cartridge during the installation or removal, and improves the operational efficiency.

Next, referring to FIGS. 20 and 21, a series of steps other than the aforementioned ones for installing or removing the process cartridge B will be described, wherein a member with the same function as the one in the preceding embodiment is given the same reference, and the description thereof is omitted for simplicity.

Figure 20:
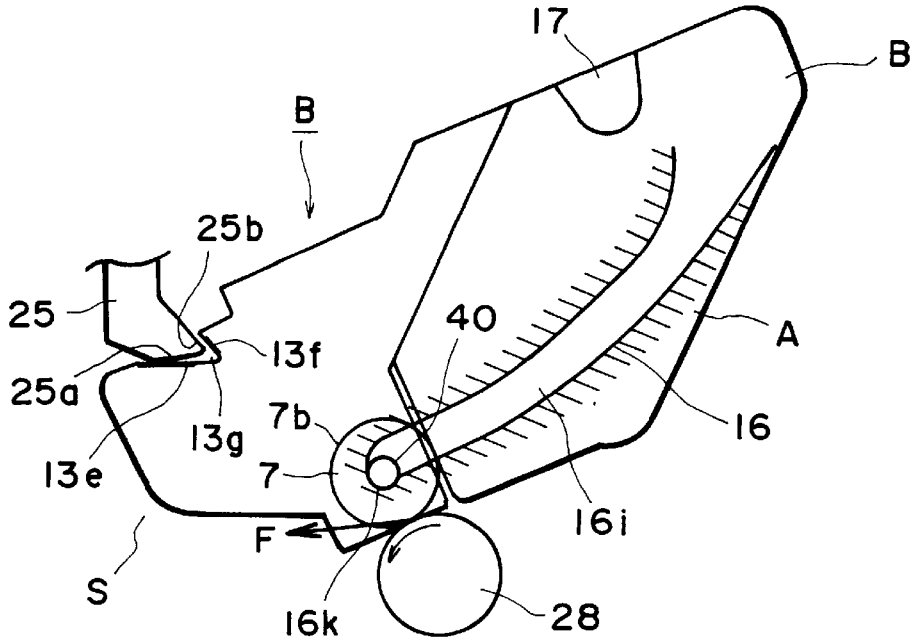
FIGS. 20 and 21 are side views of a different process cartridge to which the first embodiment of the present invention has been applied.

In this embodiment, the process cartridge B comprises a pair of shafts 40 as positioning portions, which project from the corresponding lateral surfaces of the cartridge frame in line with the rotational axis 7*a* of the photosensitive drum 7 (FIG. 20 shows only one side), and also, guide members 16, which are disposed on the corresponding left and right sides. The guide member 16 is provided with a guide groove 16*i,* which extends diagonally downward and guides the positioning shaft 40 when the cartridge B is installed. There is a recessed portion 16*k* at the deepest end of the guide groove 16*i*. As the positioning shaft 40 drops into this recessed portion 16*k,* the position of the cartridge B in the apparatus is fixed.

In other words, the position of the process cartridge B in the apparatus A is fixed as it is inserted into the apparatus A, allowing its positioning shafts 40 projecting from the corresponding lateral surfaces of the cartridge frame to follow the corresponding guide grooves 16*i* until the shafts 40 drop into the corresponding positioning recesses 16*k*.

Figure 21:
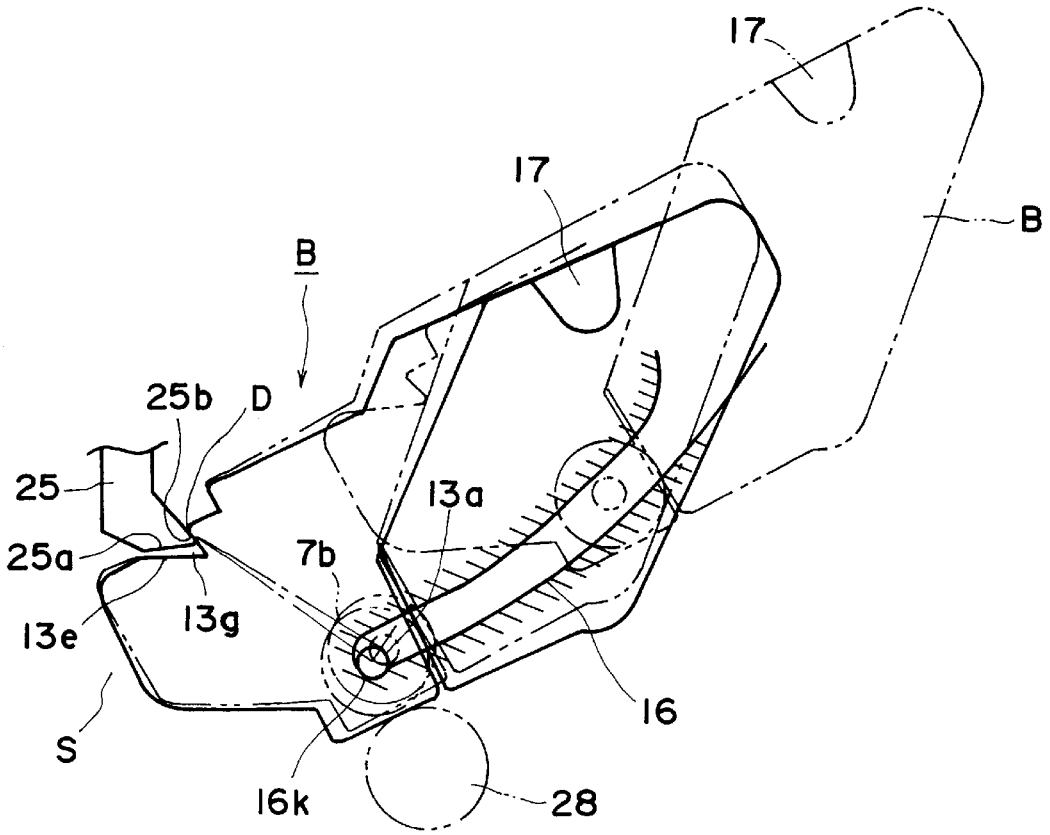

Referring to FIGS. 2 and 21, also in this embodiment, the regulatory contact portion 13*e* and disengagement contact portion 13*f* are on the top portion of the cartridge frame, but the rotation regulating portion 25*a* and disengagement contact portion 25*b* are integrated into a single piece.

In other words, a recessed portion 13*g* is provided on the top surface of the process cartridge B, and two surfaces of this recessed portion 13*g* serve as the regulatory contact portion 13*e* and disengagement contact portion 13*f,* respectively. The image forming apparatus A is also provided with the fixed member 25, which is disposed so as to be above the installed process cartridge B and to fit into the recessed portion 13*g*. Two surfaces of this fixed member 25 serve as the rotation regulating portion 25*a* and disengagement contact portion 25*b*.

With such an arrangement as described above in place, when the process cartridge B is installed into the apparatus A main assembly, the regulatory contact portion 13*e* makes contact with the rotation regulating portion 15*a* as shown in FIG. 20. When the process cartridge B is taken out, the disengagement contact portion 13*f* makes contact with the disengagement contact portion 25*b* as the operator grabs and lifts the cartridge B, whereby the cartridge B is rotated about the contact point D. As a result, the cylindrical member 13*a* is lifted out of the groove 16*a*5, and the engagement between the drum gear 7*b* and driving gear 28 is broken.

Since the fixed member 25 is not in the path of the recording medium, it is unnecessary to be concerned about its interference with the recording medium; therefore, there is no limitation regarding the component positioning.

Further, a single member integrally comprises both the rotation regulating contact portion 25*a* and disengagement contact portion 25*b;* therefore, a more precise component can be produced; the component cost can be reduced; and the positional accuracy can be improved.

Also, this embodiment exemplifies a case in which the fixed member 25 is disposed so as to be positioned above the installed process cartridge B. However, this fixed member 25 may be disposed so as to be positioned on the lateral side of the installed process cartridge B.

Next, referring to FIGS. 22 and 23, another sequence of steps for installing or removing the process cartridge B will be described.

Figure 22:
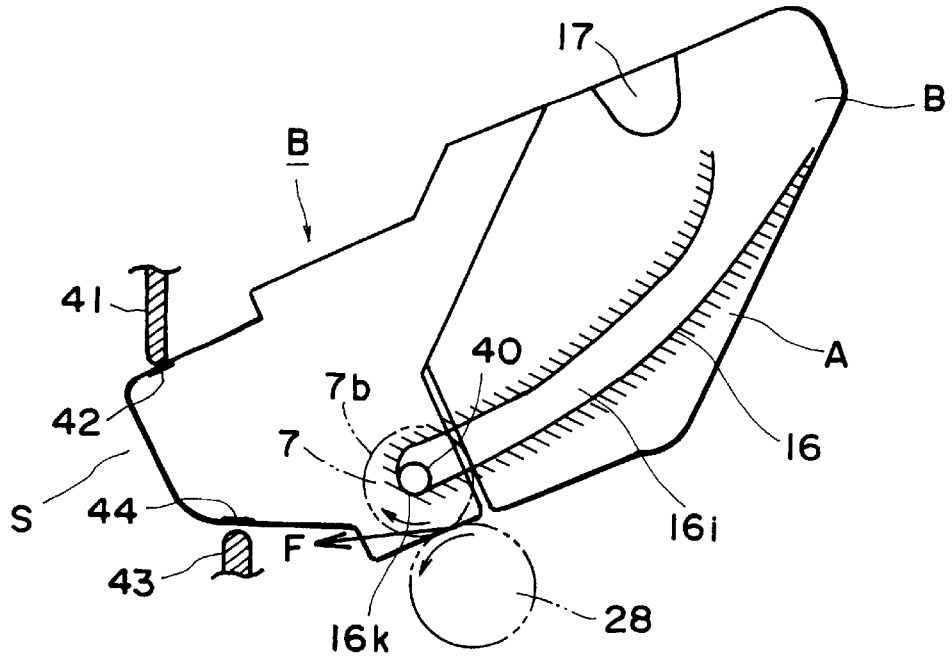
FIGS. 22–25 are side views of different process cartridges to which the first embodiment of the present invention has been applied.

Referring to FIG. 22, in this embodiment, the regulatory contact portion 42 is formed on the top surface of the process cartridge B frame, at the leading end portion relative to the direction in which the process cartridge B is inserted into the image forming apparatus A. This regulatory contact portion 42 makes contact with the rotation regulating portion 41, which will be described later. Also, on the bottom surface of the cartridge B frame, the disengagement contact portion 44 is formed. This disengagement contact portion 44 makes contact with the disengagement projection 43, which will be described later.

Also referring to FIG. 22, the apparatus A comprises: a rotation regulating portion 41, which is disposed in such a manner that as the process cartridge B is inserted along the guide groove 16*i* and the positioning shaft 40 drops into the recessed portion 16*k,* it is positioned above the regulatory contact portion 42; and the disengagement projection 43, which is disposed so as to be positioned below the disengagement contact portion 44.

The process cartridge B comprises the drum gear 7*b,* which is mounted on the rotational shaft 7*a* of the photosensitive drum 7. This drum gear 7*b* engages with the driving gear 28 provided on the apparatus A main assembly, before the positioning shaft 40 of the cartridge B drops into the recessed portion 16*k.* The driving force is transmitted to the photosensitive drum 7 through this engagement. At this time, as the gears 7*b* and 28 engage, a clockwise moment about the positioning shaft 40 is generated on the process cartridge B by a force F exerted by the operator for engaging the gears 7*b* and 28. The regulatory contact portion 42 of the process cartridge B is caused to contact the rotation regulating portion 41 by this moment, whereby the orientation of the process cartridge B is maintained.

Figure 23:
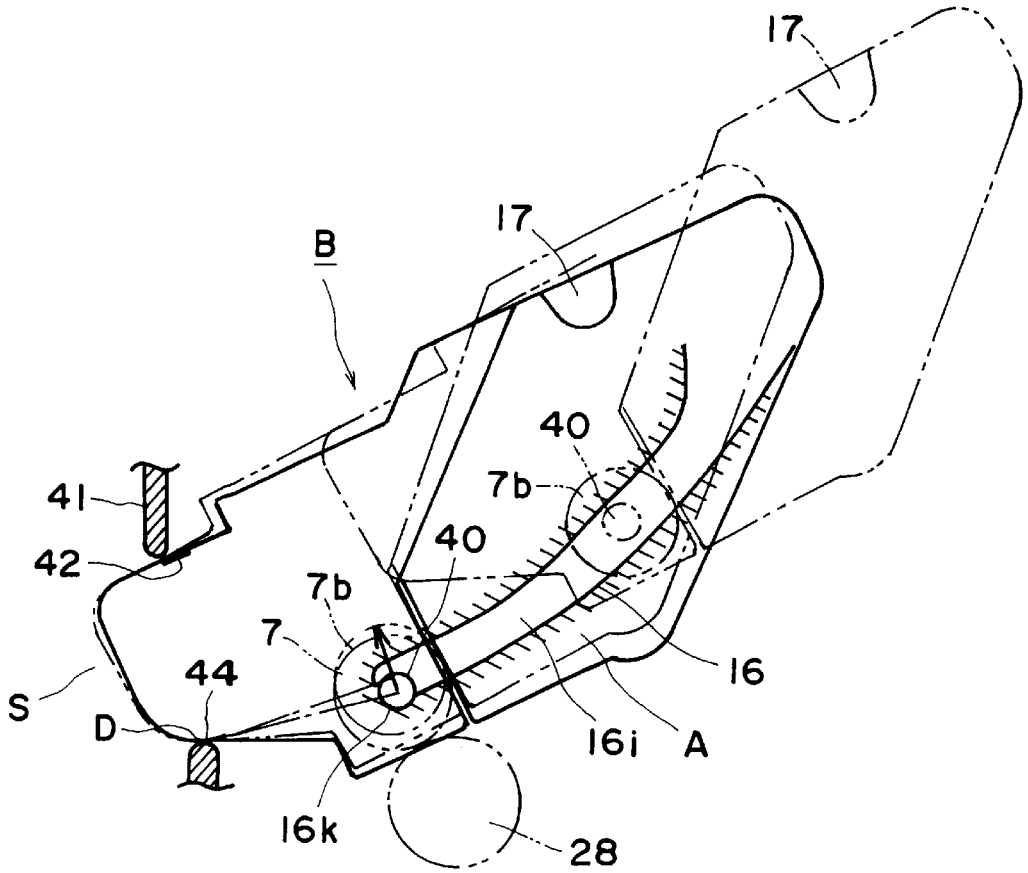

On the other hand, referring to FIG. 23, when the process cartridge B is removed, the operator first grips the handle portion of the cartridge B and pulls this portion upward, which causes the process cartridge B to rotate counterclockwise about the positioning shaft 40. As a result, the disengagement contact portion 44 makes contact with the disengagement projection 43. Next, as the operator pulls the process cartridge further upward, the process cartridge B is rotated about the contact point D between the contact portions 44 and 43 this time. In other words, the process cartridge B functions like a lever, the fulcrum of which is the contact point D; therefore, the positioning shaft 40 is lifted out of the positioning recessed portion 16*k,* and at the same time, the engagement between the drum gear 7*b* and driving gear 28 is broken. In this state, the process cartridge B can be pulled straight out of the apparatus A main assembly along the guide groove 16*i*.

When the contact portions 42 and 44 of the process cartridge B, and the rotation regulating portion 41 and disengagement contact portion 43 of the image forming apparatus A main assembly are constructed as described above, the process cartridge B can be properly installed; its orientation can be properly maintained; and also, the gears can be easily disengaged during the cartridge removal.

Next, referring to FIGS. 24 and 25, another sequence of steps for installing or removing the process cartridge B will be described.

Figure 24:
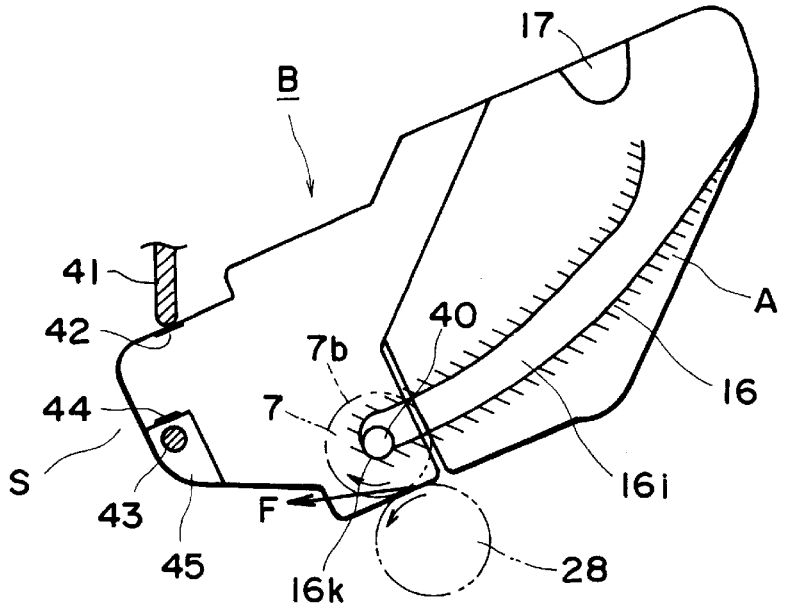
Figure 25:
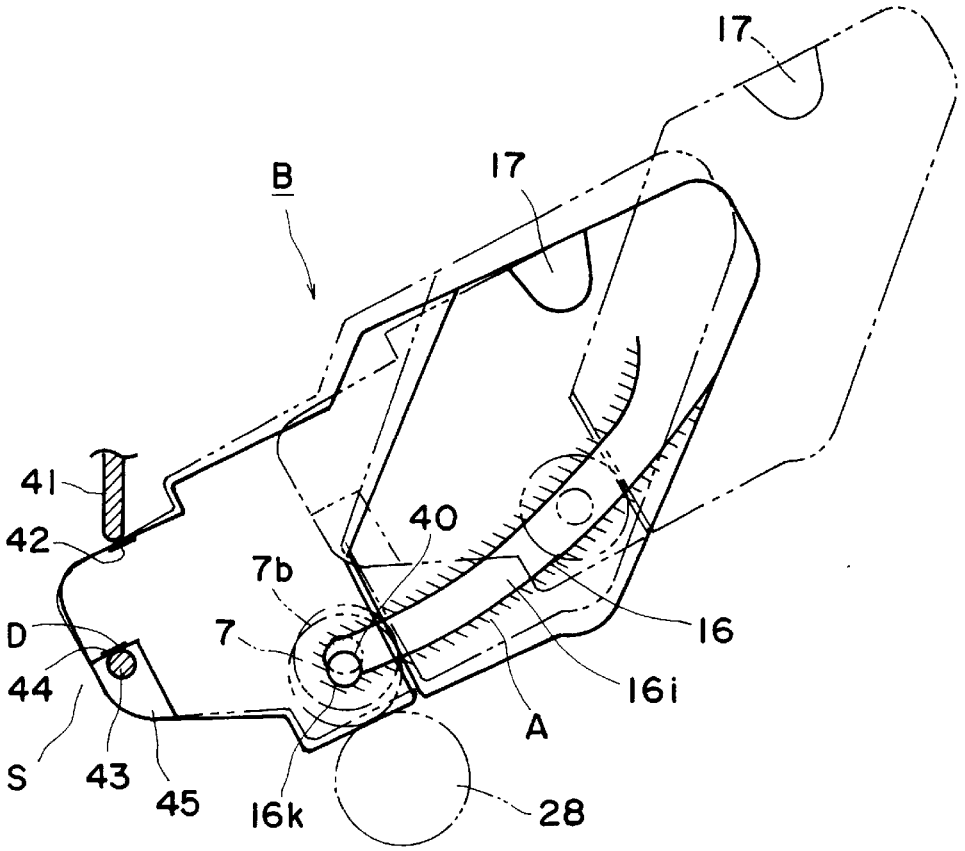

This embodiment depicted in FIGS. 24 and 25 is different from the embodiment depicted in FIGS. 22 and 23 in that the disengagement contact portion 44 of the process cartridge B is disposed to be on the lateral surface of the cartridge frame, and the disengagement contact portion 43 on the image forming apparatus A side, with which this contact portion 44 makes contact, is positioned on the internal lateral surface of the apparatus main assembly.

In other words, a recessed portion 45 is formed on each of the lateral surfaces of the cartridge frame, wherein one surface (the top surface of the recessed portion 45) is used as the disengagement contact portion 44. As for the disengagement contact portion 43, they project into the cartridge accommodating space S from the corresponding predetermined locations on the corresponding lateral walls of the space S.

When such an arrangement as described above is made, not only can the same effects as the preceding embodiments be obtained, but also the number of requirements regarding the component positioning can be reduced. More specifically, referring to FIG. 25, the contact portion 44 makes contact with the contact projection 43, and the contact point between them serves as the rotational center of the cartridge B. This contact portion 44 and contact projection 43 are not in the recording medium path; therefore, it is unnecessary to be concerned about their interference with the recording medium, which in turn reduces the number of restrictions regarding the component positioning.

[Structure of Electrical Contact Points]

Hereinafter referring to FIGS. 5, 8, 9 and 19, the structure of the contact point, which makes electrical connections between the process cartridge B and the image forming apparatus A main assembly when the former is installed into the latter, will be described.

The process cartridge B is provided with a plurality of electrical contact points: (1) Electrically conductive grounding contact point 119 electrically connected to the photosensitive drum 7 to ground the drum 7 through the apparatus main assembly A; (2) Electrically conductive charging bias contact point 120 electrically connected to the charging roller shaft 8*a;* (3) Electrically conductive developing bias contact point 121 electrically connected to the developing roller 9*b* in order to apply a developing bias from the apparatus main assembly A; and (4) Electrically conductive toner detecting contact point 122 electrically connected to an antenna wire (line) in order to detect the amount of the remaining toner. All of these four contact points 119–122 are exposed on the lateral surface (right-hand side) of the cartridge frame, with intervals large enough to prevent electrical leakage among them. It should be noted here that the toner detecting contact point 122 doubles as a cartridge detecting contact point for detecting the presence (or absence) of the process cartridge within the apparatus A main assembly.

The grounding contact point 119 is constituted of the electrically conductive axial shaft 7*a* of the photosensitive drum 7, or an electrically conductive insert molded in the shaft 7 of resin material. In this embodiment, it is constituted of a metallic shaft 7*a* of iron or the like. The other contact points 120, 121 and 122 are approximately 0.1 mm to 0.3 mm thick electrically conductive metallic pieces, which are mounted on the surface so as that their leg portions reach into the process cartridge interior. The charging contact point 120 is exposed on the driving side surface (lateral side C1) of the cleaning unit C, and the developing contact point 121 and toner detecting contact point 122 are exposed on the driving side surface (lateral side D1) of the developing unit D.

More specifically, in this embodiment, the helical gear 7*b* is provided at one end of the photosensitive drum 7 in the axial direction of the drum 7 as described before. This helical gear 7*b* engages with the helical gear 28 provided on the apparatus A main assembly to rotate the drum 7. As this helical gear 7*b* rotates, it generates a thrust (in the direction of an arrow d in FIG. 26), pressing thereby the drum 7, which is mounted on the cleaning means frame portion 13 with the allowance of some play in its longitudinal direction, toward the direction of the helical gear 7*b.* As a result, one 7*b*1 of the lateral surfaces of the helical gear 28 remains in contact with the internal surface 13*b*1 of one 13*b* of the lateral surfaces of the cleaning means frame portion 13 of the cartridge frame, whereby the position of the drum 7 within the cartridge B in the axial direction is regulated. The grounding contact point 119 and charging bias contact point 120 are exposed on the one 13*b* of the lateral surfaces of the cleaning means portion 13 of the frame, wherein the grounding contact point 119 is at the end of the drum shaft 7*a,* and projects outward slightly (approximately 0.8 mm) beyond the end of the aforementioned cylindrical member 13*a*. This drum shaft 7*a* is put through the drum cylinder 7*d* (aluminum cylinder in this embodiment) covered with a photosensitive layer 7*e*, and is supported at each end by the cylindrical member 13*a*, which in turn is supported on the lateral walls 13*c* and 13*d*. The drum cylinder 7*d* and shaft 7*a* are connected with a grounding plate 7*f*, which is in contact with both the internal surface 7*d*1 of the drum cylinder 7*d* and peripheral surface 7*a*1 of the shaft 7*a*.

The charging bias contact point 120 is located almost directly above the long guide 122, that is, adjacent to the cleaning means portion 13 of the frame, which supports the charging roller 8 (FIG. 5). Also, the charging bias contact point 120 is electrically connected to the charging roller shaft 8*a* through an electrically conductive member 120*a*, which is in contact with the charging roller shaft 8*a*.

Next, the developing bias contact point 121 and toner detecting contact point 122 will be described. These two contact points 121 and 122 are located on one surface, D1, of the lateral surface of the developing unit D, that is, the same side as the lateral surface 13*b* of the cleaning means portion 13 of the frame. The developing bias contact point 121 is located directly below the long guide 12*a* and adjacent to the frame portion 12*c* where the magnet 9*d* contained in the developing roller 9*c* is supported (FIG. 5), and is electrically connected to the developing roller 9*c* through the electrically conductive member 121*a*, which is in contact with the lateral end of the developing roller 9*c* (FIG. 9(*b*)). The toner detecting contact point 122 is disposed on the upstream side of the long guide 12*a* relative to the cartridge inserting direction (arrow X direction), and is connected to an antenna rod 9*e* extending in the longitudinal direction of the developing roller 9*c* parallel to the developing roller 9*c*, through the electrically conductive member 9*f*, which is in contact with an antenna rod 9*e*. The antenna rod 9*e* is disposed so as to hold a predetermined distance from the developing roller 9*c*. The capacitance between this antenna rod 9*e* and developing roller 9*c* varies in response to the amount of the toner present between the two components; therefore, the amount of the remaining toner is detected by measuring this capacitance change as a potential difference change through a detecting circuit (unillustrated) in the apparatus A main assembly.

Here, the terminology "amount of the remaining toner" means an amount of the toner that creates a predetermined amount of capacitance by being present between the developing roller 9*c* and antenna rod 9*e*. In other words, the detection of the predetermined amount of capacitance means that the amount of the toner remaining in the toner chamber lla has reached the predetermined amount.

Thus, it is detected by the detecting circuit, which is provided in the apparatus A main assembly and is connected to the cartridge B through the toner detecting contact point 122, that the capacitance has reached a predetermined first value; whereby it is determined that the amount of the toner remaining in the toner chamber lla has reached the predetermined amount. When it is detected that the capacitance has reached the aforementioned first determined value, the apparatus A main assembly signals the need for process cartridge B exchange (for example, by a flashing light, a buzzing sound and the like). When the capacitance detected by the detecting circuit matches a predetermined second value, which is smaller than the first value, the detecting circuit determines that the cartridge B has been installed in the apparatus A main assembly. The detecting circuit does not allow the apparatus A main assembly to be driven unless it detects that the cartridge B has been installed in the apparatus main assembly. It may be arranged so that a warning signal (for example, a blinking light or the like) may be provided to inform the operator of the absence of the cartridge B in the apparatus.

Next, a description will be given as to the connection between the contact point provided on the cartridge B and the contact point member provided on the apparatus main assembly.

Referring to FIG. 19, four contact point members, which make contact with corresponding contact points 119–122 when the process cartridge is installed in the apparatus A, are provided on one of the lateral walls of the cartridge accommodating space S of the image forming apparatus A (grounding contact point member 123 which contacts the grounding contact point 119, charging bias contact point member 124 which contacts the charging bias contact point 120, developing contact point member 125 which contacts the developing bias contact point 121, and toner detection contact point member 126 which contacts the toner detecting contact point 122).

As shown in FIGS. 19(*a*) and 19(*b*), the grounding contact point member 123 is disposed in correspondence to the groove 16*a*5. The developing bias contact point member 125 and toner detecting contact point member 126 are disposed below the first guide portion 16*a*. The charging bias contact point member 124 is disposed above the second guide portion 16*b*.

Here, the positional relationship between the contact points and guides will be described.

First, as for the positional relationship in the vertical direction (as seen from the horizontal direction), the developing bias contact point 121 is the bottommost one; the toner detecting contact point 122, long guide 12*a* and cylindrical member 13*a* (grounding contact point 119) are disposed above the bias contact point 121, being at about the same level; above them is the short guide 13*b*, and the topmost one is the charging bias contact point 120. As for the positional relationship in the cartridge inserting direction (arrow X direction), the toner detecting contact point 122 is the most upstream one; next is the long guide 12*a*; at a further downstream location is the charging bias contact 120 and developing bias contact point 121; and at the most downstream locations are short guide 13*b* and cylindrical member 13*a* (grounding contact point 119). Arranging the contact points as described above allows the charging bias contact point 120 to be positioned near the charging roller 8; the developing bias contact point 121, near the developing roller 9*c*; the toner detecting contact point 122, near the antenna rod 9*e*; and the grounding contact point 119 to be positioned near the photosensitive drum 7. Therefore, the wiring for the contact points can be shortened.

The measurements of the contact points are as follows: the charging bias contact point 120 is approximately 10.0 mm in height and width (tolerable range of 8.0 mm to 12.0 mm); developing bias contact point 121, approximately 9.0 mm in height (tolerable range of 6.0 mm to 12.0 mm) and approximately 8.0 mm (tolerable range of 5.0 mm to 11.0 mm); toner detecting contact point 122, approximately 8.0 mm (tolerable range of 6.0 mm to 10.0 mm) in height and approximately 9.0 mm (tolerable range of 7.0 mm to 11.0 mm) in width; and grounding contact point 119 is circular and its diameter is approximately 7.0 mm. The charging bias contact point 120, developing bias contact point 121, and toner detecting contact point 122 are rectangular.

Figure 26:
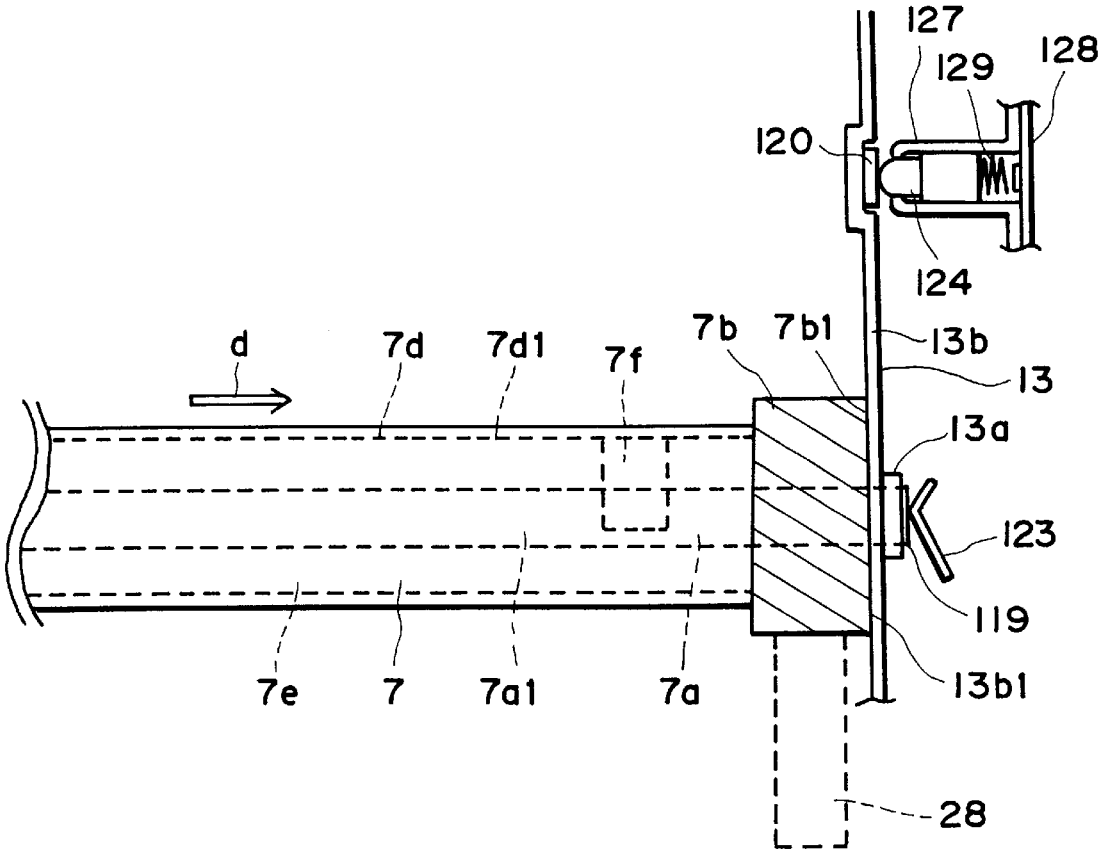
FIGS. 26 and 27 are sectional views of the portion of the process cartridge which depict how contact points remain in contact with the corresponding contact members.

The grounding contact point member 123 is an electrically conductive plate spring member, and is mounted in the groove 16*a*5, in which the cylindrical member 13*a* (in which the drum shaft 7*a* of the photosensitive drum 7 is fitted), on which the grounding contact point 119 of the cartridge B is mounted, is disposed to fix the position of the cartridge B, whereby the grounding contact point member 123 is grounded through the chassis of the apparatus main assembly (FIGS. 16 and 26). The other contact point members 124, 125 and 126 are mounted in the corresponding holder covers 127 in such a manner as to be projected therefrom by the corresponding compression springs 129. This arrangement will be described referring to the charging bias contact point member 124. Referring to FIG. 26, the charging bias contact point member 124 is placed under a holder cover so that it projects but does not come off, and then, this holder cover 127 is fixed to a circuit board 128 mounted on one of the lateral walls of the apparatus main assembly, whereby the contact point members are electrically connected to the wiring patterns by the electrically conductive compression springs 129, correspondingly.

Figure 27:
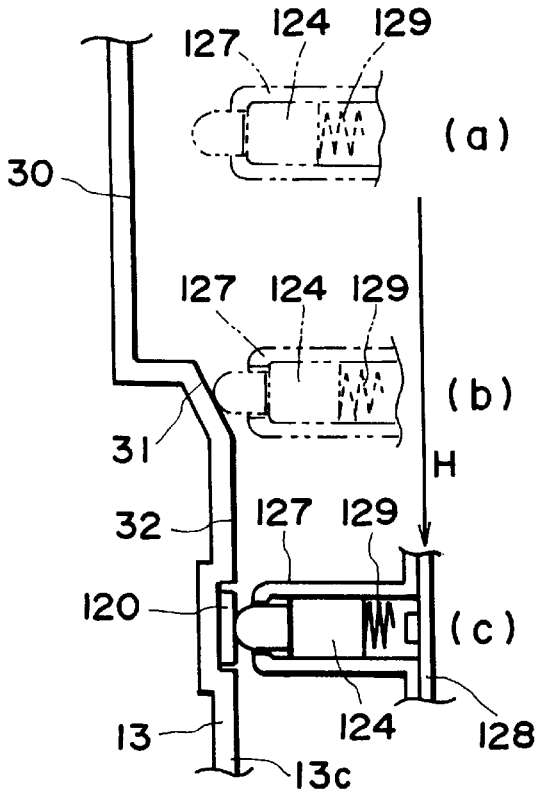

Next, referring to FIG. 27, it will be described with reference to the charging bias contact point member 119 how the contact points on the cartridge side come in contact with the corresponding contact point members on the image forming apparatus side when the process cartridge B is installed into the image forming apparatus A. FIG. 27 is an explanatory drawing, which depicts the state of the process cartridge B in the image forming apparatus A, wherein an arrow mark H designates the movement of the charging bias contact point 124 on the apparatus main assembly, relative to the process cartridge B, when the cartridge B is installed into the image forming apparatus A. It should be noted here that FIG. 27 is a cross section of FIG. 5 at a line O.

During the installation of the process cartridge B into the image forming apparatus A using the guide members 16*a* and 16*b* as the guide, the charging bias contact point member 124 is in the state depicted in FIG. 27 before it reaches the predetermined position where it is to be fixedly disposed. At this time, the charging bias contact point member 124 is not in contact with the flat surface 20 of the cleaning means portion 13 of the frame. As the cartridge B is further inserted, the charging bias contact point member 124 is advanced to a position (b) in FIG. 27. In this state, it remains in contact with the slanted surface 31 (FIG. 5) formed on the lateral wall of the cleaning means portion 13 of the frame; slides on this slanted surface 31, whereby it is gradually pressed, thereby compressing gradually the compression spring 129; and smoothly moves onto the flat surface 32 where the charging bias contact point 120 is exposed. When the inserted cartridge B arrives at the predetermined location, the contact member 124 arrives at a position (c) in FIG. 27, where it makes contact with the charging bias contact point 120. The other contact point members 125 and 126 come in contact with the contact points 121 and 122, respectively, in the same manner.

With such an arrangement as described above being in place, when the cartridge B is guided by the guide member 16 into the predetermined cassette accommodating location, the contact points and the corresponding contact point members are reliably placed in contact with each other.

Further, when the process cartridge B is positioned at the predetermined location in the apparatus A main assembly, the grounding contact point member 123 in the form of a plate spring makes contact with the grounding contact point 119 projecting from the cylindrical member 13*a* (FIG. 26).

Next, a case in which the photosensitive 7 is rotated by driving the image forming apparatus A, will be described. The photosensitive drum 7 is given an approximately 2 mm to 3 mm thrust play in the axial direction so that it is easier to install the process cartridge B into the image forming apparatus A. Therefore, it is necessary for the charging bias contact point member 124 or the like to be capable of projecting by a distance larger than the thrust play. Further, in this embodiment, a plate spring 45 is provided, which presses the process cartridge B toward one side (the side where the contact point members 123–126 are located) of the apparatus main assembly when the cartridge B is in the apparatus main assembly. This plate spring 45 is on the side opposite to the side where the contact point members are located, above the first installation guide 16*a*.

Further, when the contact points 119–122 of the process cartridge B are disposed, as they are in this embodiment, on the side where the helical gear 7*b* is disposed (lateral wall on the driving side), the connection for mechanically driving the cartridge B by the apparatus main assembly through the helical gear 7*b*, and the electrical connection between the cartridge B and apparatus main assembly through the contact points 119–122, can be made on the same side of the cartridge B. Therefore, when the aforementioned side of the cartridge B is used as the referential side, the integrated error in the component sizes can be reduced, which makes it possible to mount more accurately the contact points and helical gear. Further, when a helical gear with teeth cut in such a direction as to generate a thrust directed toward the side where the helical gear is positioned is used, the position of the photosensitive drum 7 in the axial direction is fixed on the side where the contact points are located; therefore, in this case, the accuracy in the positional relationship between the photosensitive drum 7 and the contact points is also improved, in addition to the aforementioned effects. Further, when a lever 18*b* for opening or closing the drum shutter 18 is located, as it is in the aforementioned embodiment, on the side opposite to the one where the contact points 119–122 are located, the frictional resistance generated on one side of the cartridge by the contact points 119–122 as the cartridge B is inserted into the image forming apparatus A is distributed to the other side as the drum shutter 18 is opened; in other words, the resistance generated when the cartridge B is inserted is evenly distributed in the longitudinal direction of the cartridge B. Therefore, the cartridge B can be smoothly inserted.

Further, as described in the preceding embodiment, when all the contact points of the process cartridge B are positioned on one and the same lateral wall of the cartridge frame, and the process cartridge B is placed under the elastic pressure generated by the plate spring, it is possible to provide stable electrical connections between the contact points and the corresponding contact point members on the apparatus main assembly side.

Figure 28:
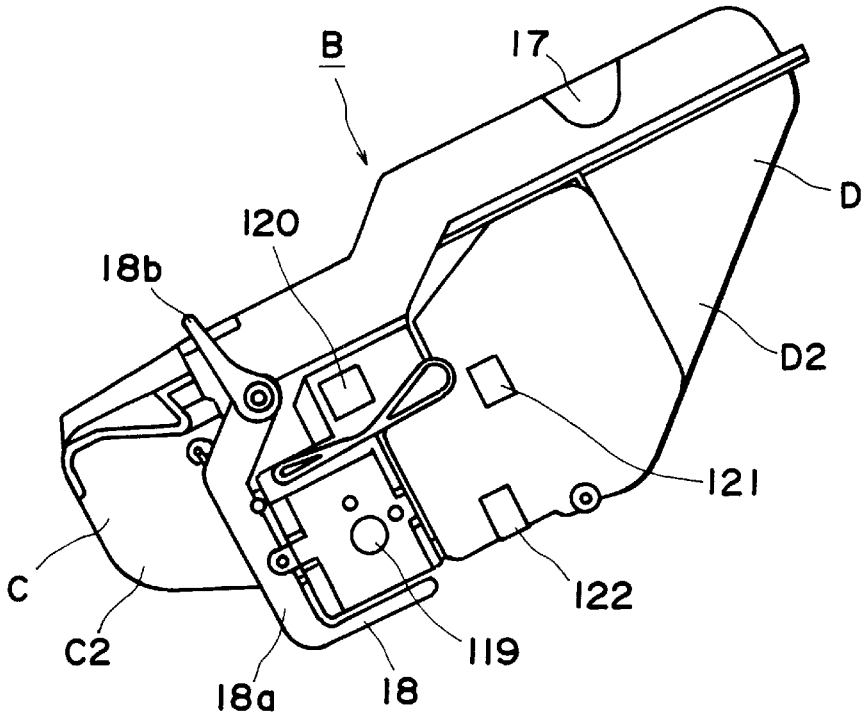
FIG. 28 is a side view of another process cartridge to which the first embodiment of the present invention has been applied.

FIG. 28 illustrates an arrangement in which the contact points are located on the side where the aforementioned lever 18*b* is located. This arrangement can also sufficiently provide the aforementioned effects.

Further, in the preceding embodiments, the process cartridge B is of a type which is used to form a monochrome image, but the present invention is also applicable to a multicolor process cartridge, which comprises two or more developing means and is used to form a multicolor image (image of two colors, three colors, or full-color).

As for the electrophotographic photosensitive member, it is not limited to the aforementioned photosensitive drum 7. The present invention is also applicable to the following. To begin with, the photoconductive material is usable as the photosensitive material. As for the photoconductive material, amorphous silicon, amorphous selenium, zinc oxide, titanium oxide, organic photoconductor (OPC), or the like, is usable. Further, as for the configuration of a base member on which the photosensitive material is placed, a base member in the form of a drum or a belt is used. For example, in the case of the base member of the drum type, the photoconductive material is coated, deposited, or placed by the like means on a cylinder of aluminum alloy or the like.

As for the developing method, the present invention is compatible with various well-known methods such as the double component magnetic brush developing method, cascade developing method, touch down developing method, cloud developing method, and the like.

Further, as to the structure of the charging means, the so-called contact charging method is employed in the first embodiment, but it is needless to say that the present invention is also applicable to other conventional charging methods such as the one in which a metallic shield of aluminum or the like is placed on three sides of a tungsten wire, and positive or negative ions generated by applying a high voltage to the tungsten wire are transferred onto the surface of the photosensitive drum to charge it uniformly.

Further, the aforementioned charging means may be of the blade type, (charging blade), pad type, block type, rod type, wire type, or the like, in addition to the roller type described previously.

As for the method for cleaning the residual toner on the photosensitive drum, the cleaning means may be constituted of a blade, fur brush, magnetic brush, or the like.

As described in the foregoing, according to the present invention, there is provided a process cartridge and an image forming apparatus usable therewith, wherein the operability of the mounting and demounting is improved.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, comprising:

an electrophotographic photosensitive member;

process means actable on said photosensitive member;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive member; and a second projection for positioning said process cartridge relative to the main assembly when the process cartridge is mounted to the main assembly, said second projection being outwardly projected from a second portion of said cartridge frame adjacent another axial end of said photosensitive member, said cartridge frame including a confining contact surface for contacting a first fixed portion of said main assembly and cooperating with said first projection and second projection to correctly position said process cartridge relative to said main assembly, when said process cartridge is mounted to said main assembly, said cartridge frame including a releasing contact surface for contacting a second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface is disposed upstream of said confining contact surface with respect to the mounting direction, the mounting direction crossing with an axis of said photosensitive member and wherein said releasing contact surface and said confining contact surface are substantially aligned in the mounting direction.

2. A process cartridge according to claim 1, wherein said first projection and second projection are coaxial.

3. A process cartridge according to claim 1 or 2, wherein said first projection and second projection are circular around a shaft for supporting said photosensitive member.

4. A process cartridge according to claim 3, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

5. A process cartridge according to claim 4, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

6. A process cartridge according to claim 4, wherein said first portion and second portion are extended from a cleaning unit which contains said photosensitive drum and a cleaning member and which is swingably mounted to a developing unit containing a developing member and a toner containing portion for containing toner to be used by said developing member.

7. A process cartridge according to claim 1, wherein said confining contact portion is provided at each of end portions of said cartridge frame with respect to an axial direction of said photosensitive member.

8. A process cartridge according to claim 1 or 7, wherein said confining contact portion has an inclined portion.

9. A process cartridge according to claim 1, wherein said releasing contact portion is provided at each of end portions of said cartridge frame with respect to an axial direction of said photosensitive member.

10. A process cartridge according to claim 1 or 9, wherein said releasing contact portion has an inclined portion.

11. A process cartridge according to claim 1, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

12. A process cartridge according to claim 11, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

13. A process cartridge according to claim 11, wherein said first portion and second portion are extended from a cleaning unit which contains said photosensitive member and a cleaning member and which is swingably mounted to a developing unit containing a developing member and a toner containing portion for containing toner to be used by said developing member.

14. A process cartridge according to claim 1, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

15. A process cartridge according to claim 1, wherein the main assembly is provided with a helical gear for transmitting a driving force, and a longitudinal end of said photosensitive member in said process cartridge is provided with a helical gear engageable with said helical gear of said main assembly to receive the driving force for rotating said photosensitive member when said process cartridge is mounted to said main assembly, wherein engagement between said helical gears is released by rotation of said process cartridge about a contact position between said releasing contact surface and the second fixed portion as a pivot when said process cartridge is demounted from said main assembly.

16. A process cartridge according to claim 1, wherein said process cartridge contains the photosensitive member, and at least one of charging means, developing means and cleaning means, as said process means, wherein said process cartridge is detachably mountable relative to said main assembly.

17. A process cartridge according to claim 1, wherein said process cartridge contains said photosensitive members and at least developing means, as said process means, wherein said process cartridge is detachably mountable relative to said main assembly.

18. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to a mounting direction of said process cartridge when said process cartridge is mounted to the main assembly, the mounting direction crossing with an axis of said photosensitive drum, wherein said confining contact portion has a portion inclined with respect to the mounting direction, in a recess extending from an upstream side toward a downstream side with respect to the mounting direction.

19. A process cartridge according to claim 18, wherein said confining contact portion is provided at each of end portions of said cartridge frame with respect to an axial direction of said photosensitive drum.

20. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of s aid photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to a mounting direction of said process cartridge when said process cartridge is mounted to the main assembly, the mounting direction crossing with an axis of said photosensitive drum, wherein said releasing contact portion has a portion inclined with respect to the mounting direction, in a recess extending from an upstream side toward a downstream side with respect to the mounting direction.

21. A process cartridge according to claim 20, wherein said releasing contact portion is provided at each of end portions of said cartridge frame with respect to an axial direction of said photosensitive drum.

22. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to a mounting direction of said process cartridge when said process cartridge is mounted to the main assembly, the mounting direction crossing with an axis of said photosensitive drum, wherein said first portion is provided with a third projection, for guiding said process cartridge, projected outwardly at a position upstream of said first projection with respect to the mount ing direction, and said second portion is provided with a fourth projection, for guiding said process cartridge, projected outwardly at a position upstream of said second projection with respect to mounting direction.

23. A process cartridge according to claim 22, wherein said first portion and second portion are extended from a developing unit which contains developing means, as said process means, for developing a latent image formed on said photosensitive member and a toner containing portion for containing toner to be used by said developing means and which is swingably mounted to a cleaning unit which contains said photosensitive member and cleaning means, as said process means, for removing residual toner remaining on said photosensitive member.

24. A process cartridge detachably mountable to a main assembly of an image forming apparatus, comprising:

an electrophotographic photosensitive drum;

a charging member for charging said photosensitive drum;

a developing member for developing a latent image formed on said photosensitive drum;

a cleaning member for removing residual toner from said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

a first long projection, for guiding said process cartridge, projected outwardly from said first portion at a position upstream of said first projection with respect to a mounting direction of said process cartridge;

a second long projection, for guiding said process cartridge, projected outwardly from said second portion at a position upstream of said second projection with respect to the mounting direction;

a confining contact surface, provided on said cartridge frame at each end portion, for contacting a first fixed portion of said main assembly and cooperating with said first projection and second projection to correctly position said process cartridge relative to said main assembly, when said process cartridge is mounted to said main assembly; and a releasing contact surface, provided on said cartridge frame at each end portion, for contacting a second fixed portion of said main assembly to provide a pivot of rotation of said process cartridge, when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface is disposed upstream of said confining contact surface with respect to the mounting direction, the mounting direction crossing with an axis of said photosensitive drum; and wherein said releasing contact surface and said confining contact surface are substantially aligned in the mounting direction.

25. A process cartridge according to claim 24, wherein said first projection and second projection are circular around a shaft for supporting said photosensitive drum.

26. A process cartridge according to claim 24, wherein said confining contact portion has an inclined portion.

27. A process cartridge according to claim 24, wherein said releasing contact portion has an inclined portion.

28. A process cartridge according to claim 24, wherein said first portion and second portion are extended from a cleaning unit which contains said photosensitive drum and said cleaning member and which is swingably mounted to a developing unit containing said developing member and a toner containing portion for containing toner to be used by said developing member.

29. A process cartridge according to claim 24, wherein the main assembly is provided with a helical gear for transmitting a driving force, and a longitudinal end of said photosensitive drum in said process cartridge is provided with a helical gear engageable with said helical gear of said main assembly to receive the driving force for rotating said photosensitive drum when said process cartridge is mounted to said main assembly, wherein engagement between said helical gears is released by rotation of said process cartridge about a contact position between said releasing contact surface and said fixed portion as a pivot, when said process cartridge is demounted from said main assembly.

30. A process cartridge detachably mountable to a main assembly of an image forming apparatus, comprising:

an electrophotographic photosensitive drum;

a charging member for charging said photosensitive drum;

a developing member for developing a latent image formed on said photosensitive drum;

a cleaning member for removing residual toner from said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

a first long projection, for guiding said process cartridge, projected outwardly from said first portion at a position upstream of said first projection with respect to a mounting direction of said process cartridge;

a second long projection, for guiding said process cartridge, projected outwardly from said second portion at a position upstream of said second projection with respect to the mounting direction;

a confining contact portion, provided on said cartridge frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on said cartridge frame at each end portion, for contacting a second fixed portion of said main assembly to provide a pivot of rotation of said process cartridge, when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to the mounting direction of said process cartridge, the mounting direction crossing with an axis of said photosensitive drum, wherein said confining contact portion has a portion inclined with respect to the mounting direction in a recess extending from an upstream side toward a downstream side with respect to the mounting direction.

31. A process cartridge detachably mountable to a main assembly of an image forming apparatus, comprising:

an electrophotographic photosensitive drum;

a charging member for charging said photosensitive drum;

a developing member for developing a latent image formed on said photosensitive drum;

a cleaning member for removing residual toner from said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

a first long projection, for guiding said process cartridge when said process cartridge is mounted to the main assembly, said first long projection being projected outwardly from said first portion at a position upstream of said first projection with respect to a mounting direction of said process cartridge;

a second long projection, for guiding said process cartridge when said process cartridge is mounted to the main assembly, said second long projection being projected outwardly from said second portion at a position upstream of said second projection with respect to the mounting direction;

a confining contact portion, provided on said cartridge frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on said cartridge frame at each end portion, for contacting a second fixed portion of said main assembly to provide a pivot of rotation of said process cartridge, when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to the mounting direction of said process cartridge, the mounting direction crossing with an axis of said photosensitive drum, wherein said releasing contact portion has a portion inclined with respect to the mounting direction, in a recess extending from an upstream side toward a downstream side with respect to the mounting direction.

32. A process cartridge detachably mountable to a main assembly of an image forming apparatus, comprising:

a n electrophotographic photosensitive drum;

a charging member for charging said photosensitive drum;

a developing member for developing a latent image formed on said photosensitive drum;

a cleaning member for removing residual toner from said photosensitive drum;

a cartridge frame;

a first projection for positioning said process cartridge relative to the main assembly when the process cartridge is mounted to the main assembly, said first projection being projected outwardly a nd coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

a first long projection, for guiding said process cartridge when said process cartridge is mounted to the main assembly, said first long projection being projected outwardly from said first portion at a position upstream of said first projection with respect to a mounting direction of said process cartridge;

a second long projection, for guiding said process cartridge when said process cartridge is mounted to the main assembly, said second long projection being projected outwardly from said second portion at a position upstream of said second projection with respect to the mounting direction;

a confining contact portion, provided on said cartridge frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on said cartridge frame at each end portion, for contacting a second fixed portion of said main assembly to provide a pivot of rotation of said process cartridge, when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to the mounting direction of said process cartridge, the mounting direction crossing with an axis of said photosensitive drum, wherein said first portion is provided with a fifth projection for guiding said process cartridge when said process cartridge is mounted to the main assembly, said fifth projection being projected outwardly at a position substantially above said first projection when said process cartridge is mounted to the main assembly, and said second portion is provided with a sixth projection for guiding said process cartridge when said process cartridge is mounted to the main assembly, said sixth projection being projected outwardly at a position substantially above said second projection when said process cartridge is mounted to the main assembly.

33. A process cartridge according to claim 32, wherein said first projection and second projection are circular around a shaft for supporting said photosensitive drum.

34. A process cartridge detachably mountable on a main assembly of an image forming apparatus, comprising:

an electrophotographic photosensitive drum;

process means actable on said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

an outwardly projected third projection, for guiding said process cartridge, on said first portion at a position, which is substantially vertically above said first projection when said process cartridge is mounted to the main assembly;

an outwardly projected fourth projection, for guiding said process cartridge, on said second portion at a position which is substantially vertically above said second projection when said process cartridge is mounted to the main assembly;

a fifth projection, for guiding said process cartridge, projected outwardly from said first portion at a position upstream of said first projection with respect to a process cartridge mounting direction;

a sixth projection, for guiding said process cartridge, projected outwardly from said second portion at a position upstream of said second projection with respect to a process cartridge mounting direction;

a confining contact portion, provided on a top surface of said cartridge frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on a top surface of said cartridge frame at each end portion, for contacting a second fixed portion of said main assembly to provide a rotation of said process cartridge, when said process cartridge is demounted from said main assembly.

35. A process cartridge according to claim 34, wherein said first projection and second projection are circular around a shaft for supporting said photosensitive drum.

36. A process cartridge according to claim 34, wherein said confining contact portion has an inclined portion.

37. A process cartridge according to claim 36, wherein the inclined portion is in a recess extending from an upstream side toward a downstream side with respect to a mounting direction of said process cartridge.

38. A process cartridge according to claim 34, wherein said releasing contact portion has an inclined portion.

39. A process cartridge according to claim 38, wherein the inclined portion is in a recess extending from an upstream side toward a downstream side with respect to a mounting direction of said process cartridge.

40. A process cartridge according to claim 34, wherein said first portion and second portion are extended from a cleaning unit which contains said photosensitive drum and cleaning means, as said process means, for removing residual toner remaining on said photosensitive drum and which is swingably mounted to a developing unit containing developing means, as said process means, for developing a latent image formed on said photosensitive drum and a toner containing portion for containing toner to be used by said developing means.

41. A process cartridge according to claim 34, wherein the main assembly is provided with a helical gear for transmitting a driving force, and a longitudinal end of said photosensitive drum in said process cartridge is provided with a helical gear engageable with said helical gear of said main assembly to receive the driving force for rotating said photosensitive drum when said process cartridge is mounted to said main assembly, wherein engagement between said helical gears is released by rotation of said process cartridge about a contact position between said releasing contact surface and the second fixed portion as a pivot when said process cartridge is demounted from said main assembly.

42. A process cartridge according to claim 15, 29 or 41, wherein when said process cartridge is demounted from said main assembly, said process cartridge is rotated about said releasing contact portion.

43. A process cartridge according to claim 34, wherein said process cartridge contains the photosensitive drum, and at least one of charging means, developing means and cleaning means, as said process means, wherein said process cartridge is detachably mountable relative to said main assembly.

44. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive member;

a cleaning blade for removing residual toner from said photosensitive drum;

a helical gear engageable with said helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

an outwardly projected third projection, for guiding said process cartridge, on said first portion at a position, which is substantially vertically above said first projection when said process cartridge is mounted to the main assembly;

an outwardly projected fourth projection, for guiding said process cartridge, on said second portion at a position which is substantially vertically above said second projection when said process cartridge is mounted to the main assembly;

a fifth projection, for guiding said process cartridge, projected outwardly from a first portion of said developing frame at a position which is upstream of said first projection with respect to a process cartridge mounting direction and which is adjacent an end in a direction of the axis of said photosensitive drum;

a sixth projection, for guiding said process cartridge, projected outwardly from a second portion of said developing frame at a position which is upstream of said first projection with respect to a process cartridge mounting direction and which is adjacent another end in a direction of the axis of said photosensitive drum;

a confining contact portion, provided on a top surface of said cartridge frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on a top surface of said cartridge frame at each end portion, for contacting a second fixed portion of said main assembly to provide a pivot of rotation of said process cartridge, when said process cartridge is demounted from said main assembly, wherein engagement between said helical gears is released by upward rotation of said process cartridge.

45. A process cartridge according to claim 44, wherein said first projection and second projection are circular around a shaft for supporting said photosensitive drum.

46. A process cartridge according to claim 44, wherein said confining contact portion has an inclined portion.

47. A process cartridge according to claim 46, wherein the inclined portion is in a recess extending from an upstream side toward a downstream side with respect to a mounting direction of said process cartridge.

48. A process cartridge according to claim 44, wherein said releasing contact portion has an inclined portion.

49. A process cartridge according to claim 48, wherein the inclined portion is in a recess extending from an upstream side toward a downstream side with respect to a mounting direction of said process cartridge.

50. A process cartridge according to claim 44, wherein outer diameters of said first projection and said second projection are 7.5–10.0 mm; lengths of said third projection and fourth projection are 3.0–17.0 mm; widths thereof are 1.5–7.0 mm; lengths of said fifth projection and said sixth projection are 15.0–41.0 mm; and widths thereof are 1.5–10.0 mm.

51. A process cartridge according to claim 34 or 44, wherein said confining contact portion and said releasing contact portion are in the form of a surface inclined with respect to the mounting direction and formed in a recess in a substantially upwardly facing side of said cartridge frame, and wherein the inclined surface constituting said releasing contact portion is upstream of the inclined surface constituting said confining contact portion with respect to a mounting direction of said process cartridge.

52. A process cartridge according to claim 51, wherein when said process cartridge is demounted from said main assembly, said process cartridge is rotated about said releasing contact portion.

53. A process cartridge according to claim 52, wherein by upward rotation of said process cartridge about the releasing contact portion, a helical gear of said process cartridge is disengaged from a helical gear of said main assembly, wherein the helical gear of said process cartridge receives a driving force from said main assembly to rotate said photosensitive member.

54. A process cartridge according to claim 51, wherein the inclined surface constituting said releasing contact portion is a bottom surface of the recess, and the inclined surface of said confining portion is a side wall of the recess, which side wall is upstream of said recess in the mounting direction.

55. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive member;

process means actable on said photosensitive member;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive member;

a second projection for positioning said process cartridge relative to the main assembly when the process cartridge is mounted to the main assembly, said second projection being outwardly projected from a second portion of said cartridge frame adjacent another axial end of said photosensitive member;

a confining contact surface, on said cartridge frame, for contacting said first fixed portion of said main assembly and cooperating with said first projection and second projection to correctly position said process cartridge relative to said main assembly, when said process cartridge is mounted to said main assembly; and a releasing contact surface, on said cartridge frame, for contacting said second fixed portion of said main assembly to provide a pivot of rotation of said process cartridge, when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface and said confining contact surface are substantially aligned in the mounting direction; and feeding means for feeding the recording material.

56. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging member for charging said photosensitive drum;

a developing member for developing a latent image formed on said photosensitive drum;

a cleaning member for removing residual toner from said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being outwardly projected and coaxially with an axis of said photosensitive drum from a second portion of said cartridge frame adjacent another axial end of said photosensitive drum;

a first long projection, for guiding said process cartridge, projected outwardly from said first portion at a position upstream of said first projection with respect to a mounting direction of said process cartridge;

a second long projection, for guiding said process cartridge, projected outwardly from said second portion at a position upstream of said second projection with respect to the mounting direction;

a confining contact surface, provided on said cartridge frame at each end portion, for contacting said first fixed portion of said main assembly and cooperating with said first projection and second projection to correctly position said process cartridge relative to said main assembly, when said process cartridge is mounted to said main assembly; and a releasing contact surface, provided on said cartridge frame at each end portion, for contacting said second fixed portion of said main assembly to provide a pivot of rotation of said process cartridge, when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly;

wherein said releasing contact surface and said confining contact surface are substantially aligned in the mounting direction; and feeding means for feeding the recording material.

57. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

process means actable on said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

an outwardly projected third projection, for guiding said process cartridge, on said first portion at a position, which is substantially vertically above said first projection when said process cartridge is mounted to the main assembly;

an outwardly projected fourth projection, for guiding said process cartridge, on said second portion at a position which is substantially vertically above said second projection when said process cartridge is mounted to the main assembly;

a fifth projection, for guiding said process cartridge, projected outwardly from said first portion at a position upstream of said first projection with respect to a mounting direction of said process cartridge;

a sixth projection, for guiding said process cartridge, projected outwardly from said second portion at a position upstream of said second projection with respect to the mounting direction;

a confining contact portion, provided on a top surface of said cartridge frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on a top surface of said cartridge frame at each end portion, for contacting a second fixed portion of said main assembly to provide a pivot of rotation of said process cartridge, when said process cartridge is demounted from said main assembly; and feeding means for feeding the recording material.

58. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with a helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

an outwardly projected third projection, for guiding said process cartridge, on said first portion at a position, which is substantially vertically above said first projection when said process cartridge is mounted to the main assembly;

an outwardly projected fourth projection, for guiding said process cartridge, on said second portion at a position which is substantially vertically above said second projection when said process cartridge is mounted to the main assembly;

a fifth projection, for guiding said process cartridge, projected outwardly from a first portion of said developing frame at a position which is upstream of said first projection with respect to a mounting direction of said process cartridge;

a sixth projection, for guiding said process cartridge, projected outwardly from a second portion of said developing frame at a position which is upstream of said first projection with respect to the mounting direction;

a confining contact portion, provided on a top surface of said cleaning frame at each end portion, for contacting a first fixed portion of said main assembly and cooperating with said first projection and second projection to correctly position said process cartridge relative to said main assembly, when said process cartridge is mounted to said main assembly; and a releasing contact portion, provided on a top surface of said cleaning frame at each end portion, for contacting a second fixed portion of said main assembly to provide a pivot of rotation of said process cartridge, when said process cartridge is demounted from said main assembly, wherein engagement between said helical gears is released by upward rotation of said process cartridge; and feeding means for feeding the recording material.

59. An apparatus according to claim 55, 56, 57 or 58, wherein said image forming apparatus is an electrophotographic printer.

60. An apparatus according to claim 55, 56, 57 or 58, wherein said image forming apparatus is a laser beam printer.

61. An apparatus according to claim 55, 56, 57 or 58, wherein said apparatus is an electrophotographic facsimile machine.

62. An apparatus according to claim 55, 56, 57 or 58, wherein said apparatus is an electrophotographic copying machine.

63. A process cartridge detachably mountable to a main assembly of an image forming apparatus, comprising:

an electrophotographic photosensitive member;

process means actable on said photosensitive member;

a cartridge frame;

a projection for positioning said process cartridge relative to the main assembly when the process cartridge is mounted to the main assembly, said projection being outwardly projected from said cartridge frame in a direction of an axis of said photosensitive member;

a confining contact surface, on said cartridge frame, for contacting a first fixed portion of said main assembly when said process cartridge is mounted to said main assembly; and a releasing contact surface, on said cartridge frame, for contacting a second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface is disposed upstream of said confining contact surface with respect to the mounting direction, the mounting direction crossing with an axis of said photosensitive member, and wherein said releasing contact surface and said confining contact surface are substantially aligned in the mounting direction.

64. A method for removing a process cartridge from a main assembly of an image forming apparatus, comprising:

a step of preparing the process cartridge, said process cartridge including:

an electrophotographic photosensitive member;

process means actable on said photosensitive member;

a cartridge frame;

a projection for positioning said process cartridge relative to the main assembly when the process cartridge is mounted to the main assembly, said projection being outwardly projected from said cartridge frame in a direction of an axis of said photosensitive member;

a confining contact surface, on said cartridge frame, for contacting a first fixed portion of said main assembly; and a releasing contact surface, on said cartridge frame, for contacting a second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface is disposed upstream of said confining contact surface with respect to the mounting direction, the mounting direction crossing with an axis of said photosensitive member, wherein said releasing contact surface and said confining contact surface are substantially aligned in the mounting direction;

a step of upwardly rotating said process cartridge with said projection as a pivot to contact the releasing contact surface to the second fixed portion; then a step of upwardly rotating said process cartridge with a contact position between said releasing contact surface and said second fixed portion as a pivot; and then a step of outwardly removing said process cartridge out of said main assembly.

65. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein said first projection and second projection are circular around a shaft for supporting said photosensitive drum, and wherein said first portion is provided with a first additional projection, for guiding said process cartridge, projected outwardly at a position upstream of said first projection with respect to the mounting direction, and said second portion is provided with a second additional projection, for guiding said process cartridge, projected outwardly at a position upstream of said second projection with respect to the mounting direction.

66. A process cartridge according to claim 65, wherein said first portion and second portion are extended from a developing unit which contains developing means, as said process means, for developing a latent image formed on said photosensitive member and a toner containing portion for containing toner to be used by said developing means and which is swingably mounted to a cleaning unit which contains said photosensitive member and cleaning means, as said process means, for removing residual toner remaining on said photosensitive member.

67. A process cartridge according to claim 65, wherein said first projection and second projection are coaxial.

68. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly, and wherein said first portion is provided with a fifth projection, for guiding said process cartridge, projected outwardly at a position upstream of said first projection with respect to the mounting direction, and said second portion is provided with a sixth projection, for guiding said process cartridge, projected outwardly at a position upstream of said second projection with respect to the mounting direction.

69. A process cartridge according to claim 68, wherein said first portion and second portion are extended from a developing unit which contains developing means, as said process means, for developing a latent image formed on said photosensitive member and a toner containing portion for containing toner to be used by said developing means and which is swingably mounted to a cleaning unit which contains said photosensitive member and cleaning means, as said process means, for removing residual toner remaining on said photosensitive member.

70. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein said first projection and second projection are circular around a shaft for supporting said photosensitive member, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly, and wherein said first portion is provided with a fifth projection, for guiding said process cartridge, projected outwardly at a position upstream of said first projection with respect to the mounting direction, and said second portion is provided with a sixth projection, for guiding said process cartridge, projected outwardly at a position upstream of said second projection with respect to the mounting direction.

71. A process cartridge according to claim 70, wherein said first portion and second portion are extended from a developing unit which contains developing means, as said process means, for developing a latent image formed on said photosensitive member and a toner containing portion for containing toner to be used by said developing means and which is swingably mounted to a cleaning unit which contains said photosensitive member and cleaning means, as said process means, for removing residual toner remaining on said photosensitive member.

72. A process cartridge according to claim 70, wherein said first projection and second projection are coaxial.

73. A process cartridge detachably mountable to a main assembly of an image forming apparatus, comprising:

an electrophotographic photosensitive member;

process means actable on said photosensitive member;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive member;

a second projection for positioning said process cartridge relative to the main assembly when the process cartridge is mounted to the main assembly, said second projection being outwardly projected from a second portion of said cartridge frame adjacent another axial end of said photosensitive member; and a grip portion, on said cartridge frame, for facilitating handling of said process cartridge when it is mounted or demounted, said cartridge frame including a confining contact surface for contacting a first fixing portion of said main assembly and cooperating with said first projection and second projection to correctly position said process cartridge relative to said main assembly, when said process cartridge is mounted to said main assembly, and said cartridge frame including a releasing contact surface for contacting a second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, and wherein said releasing contact surface and said confining contact surface are substantially aligned in the mounting direction.

74. A process cartridge detachably mountable to a main assembly of an image forming apparatus, comprising:

an electrophotographic photosensitive member;

process means actable on said photosensitive member;

a cartridge frame;

an exposure opening, formed in said cartridge frame, for permitting image light to be projected on said photosensitive member from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive member; and a second projection for positioning said process cartridge relative to the main assembly when the process cartridge is mounted to the main assembly, said second projection being outwardly projected from a second portion of said cartridge frame adjacent another axial end of said photosensitive member, said cartridge frame including a confining contact surface for contacting a first fixed portion of said main assembly and cooperating with said first projection and second projection to correctly position said process cartridge relative to said main assembly, when said process cartridge is mounted to said main assembly, and said cartridge frame including a releasing contact surface for contacting a second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, and wherein said releasing contact surface and said confining contact surface are substantially aligned in the mounting direction.

75. A process cartridge according to claim 73 or 74, wherein said first projection and second projection are coaxial.

76. A process cartridge according to claim 75, wherein said first projection and second projection are circular around a shaft for supporting said photosensitive member.

77. A process cartridge according to claim 76, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

78. A process cartridge according to claim 77, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

79. A process cartridge according to claim 73 or 74, wherein said confining contact portion is provided at each of end portions of said cartridge frame with respect to an axial direction of said photosensitive member.

80. A process cartridge according to claim 79, wherein said confining contact portion has an inclined portion.

81. A process cartridge according to claim 73 or 74, wherein said releasing contact portion is provided at each of end portions of said cartridge frame with respect to an axial direction of said photosensitive member.

82. A process cartridge according to claim 81, wherein said releasing contact portion has an inclined portion.

83. A process cartridge according to claim 73 or 74, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

84. A process cartridge according to claim 83, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

85. A process cartridge according to claim 73 or 74, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

86. A process cartridge according to claim 73 or 74, wherein said first portion and second portion are extended from a developing unit which contains developing means, as said process means, for developing a latent image formed on said photosensitive member and a toner containing portion for containing toner to be used by said developing means and which is swingably mounted to a cleaning unit which contains said photosensitive member and cleaning means, as said process means, for removing residual toner remaining on said photosensitive member.

87. A process cartridge according to claim 73 or 74, wherein the main assembly is provided with a helical gear for transmitting a driving force, and a longitudinal end of said photosensitive member in said process cartridge is provided with a helical gear engageable with said helical gear of said main assembly to receive the driving force for rotating said photosensitive member when said process cartridge is mounted to said main assembly, wherein engagement between said helical gears is released by rotation of said process cartridge when said process cartridge is demounted from said main assembly.

88. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum; and a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum, said cleaning frame including a confining contact surface for contacting a first fixed portion of said main assembly and cooperating with said first projection and second projection to correctly position said process cartridge relative to said main assembly, when said process cartridge is mounted to said main assembly, and said cleaning frame including a releasing contact surface for contacting a second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly; wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface is disposed upstream of said confining contact surface with respect to the mounting direction, the mounting direction crossing with an axis of said photosensitive drum, wherein said releasing contact surface and said confining contact surface are substantially aligned in the mounting direction, and wherein engagement between said helical gears is released by upward rotation of said process cartridge.

89. A process cartridge according to claim 88, wherein said first projection and second projection are coaxial.

90. A process cartridge according to claim 89, wherein said first projection and second projection are circular around a shaft for supporting said photosensitive member.

91. A process cartridge according to claim 90, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

92. A process cartridge according to claim 91, wherein said first portion and second portion are extended from a cleaning unit which contains said photosensitive drum and said cleaning blade and which is swingably mounted to a developing unit containing said developing roller and a toner containing portion for containing toner to be used by said developing roller.

93. A process cartridge according to claim 89, wherein said confining contact portion is provided at each of end portions of said cleaning frame with respect to an axial direction of said photosensitive drum.

94. A process cartridge according to claim 93, wherein said confining contact portion has an inclined portion.

95. A process cartridge according to claim 88, wherein said releasing contact portion is provided at each of end portions of said cleaning frame with respect to an axial direction of said photosensitive drum.

96. A process cartridge according to claim 95, wherein said releasing contact portion has an inclined portion.

97. A process cartridge according to claim 88, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

98. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting a first fixed portion of said main assembly and cooperating with said first projection and second projection to correctly position said process cartridge relative to said main assembly, when said process cartridge is mounted to said main assembly; and a releasing contact portion, provided on said cleaning frame, for contacting a second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge about a contact portion between said releasing contact portion and said second fixed portion, wherein said first projection and second projection are circular around a shaft for supporting said photosensitive drum, wherein said confining contact portion and said releasing contact portion are in the form of a surface inclined with respect to the mounting direction and formed in a recess in a substantially upwardly facing side of said cleaning frame, and the inclined surface constituting said releasing contact portion is upstream of the inclined surface constituting said confining contact portion with respect to the mounting direction, and wherein the inclined surface constituting said confining contact portion is a bottom surface of the recess provided at a downstream side with respect to the mounting direction, and the inclined surface of said releasing contact portion is a side wall of the recess, which side wall is upstream of said recess in the mounting direction.

99. A process cartridge according to claim 98, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

100. A process cartridge according to claim 99, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

101. A process cartridge according to claim 98, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

102. A process cartridge according to claim 98, wherein said first projection and second projection are coaxial.

103. A process cartridge according to claim 102, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

104. A process cartridge according to claim 102, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

105. A process cartridge according to claim 98, wherein said confining contact portion is provided at each of end portions of said cleaning frame with respect to an axial direction of said photosensitive drum.

106. A process cartridge according to claim 98, wherein said releasing contact portion is provided at each of end portions of said cleaning frame with respect to an axial direction of said photosensitive drum.

107. An image forming apparatus for forming an image on a recording material, comprising:

a first fixed portion;

a second fixed portion; and mounting means for removably mounting a process cartridge to a main assembly of said image forming apparatus, said process cartridge including:

an electrophotographic photosensitive member;

process means actable on said photosensitive member;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive member;

a second projection for positioning said process cartridge relative to the main assembly when the process cartridge is mounted to the main assembly, said second projection being outwardly projected from a second portion of said cartridge frame adjacent another axial end of said photosensitive member; and a grip portion, on said cartridge frame, for facilitating handling of said process cartridge when it is mounted or demounted, said cartridge frame including a confining contact surface for contacting said first fixed portion of said main assembly and cooperating with said first projection and second projection to correctly position said process cartridge relative to said main assembly, when said process cartridge is mounted to said main assembly, and said cartridge frame including a releasing contact surface for contacting said second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface and said confining contact surface are substantially aligned in the mounting direction.

108. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive member;

process means actable on said photosensitive member;

a cartridge frame;

an exposure opening, formed in said cartridge frame, for permitting image light to be projected on said photosensitive member from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive member; and a second projection for positioning said process cartridge relative to the main assembly when the process cartridge is mounted to the main assembly, said second projection being outwardly projected from a second portion of said cartridge frame adjacent another axial end of said photosensitive member, said cartridge frame including a confining contact surface for contacting said first fixed portion of said main assembly and cooperating with said first projection and second projection to correctly position said process cartridge relative to said main assembly, when said process cartridge is mounted to said main assembly, and said cartridge frame including a releasing contact surface, on said cartridge frame, for contacting said second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface and said confining contact surface are substantially aligned in the mounting direction.

109. An image forming apparatus according to claim 107 or 108, wherein said first projection and second projection are coaxial.

110. An image forming apparatus according to claim 109, wherein said first projection and second projection are circular around a shaft for supporting said photosensitive member.

111. An image forming apparatus according to claim 110, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

112. An image forming apparatus according to claim 111, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

113. An image forming apparatus according to claim 107 or 108, wherein said confining contact portion is provided at each of end portions of said cartridge frame with respect to an axial direction of said photosensitive drum.

114. An image forming apparatus according to claim 113, wherein said confining contact portion has an inclined portion.

115. An image forming apparatus according to claim 107 or 108, wherein said releasing contact portion is provided at each of end portions of said cartridge frame with respect to an axial direction of said photosensitive drum.

116. An image forming apparatus according to claim 115, wherein said releasing contact portion has an inclined portion.

117. An image forming apparatus according to claim 107 or 108, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

118. An image forming apparatus according to claim 117, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

119. An image forming apparatus according to claim 117, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

120. An image forming apparatus according to claim 107 or 108, wherein said first portion and second portion are extended from a cleaning unit which contains said photosensitive member and cleaning means, as said process means, for removing residual toner remaining on said photosensitive member and which is swingably mounted to a developing unit containing developing means, as said process means, for developing a latent image formed on said photosensitive member and a toner containing portion for containing toner to be used by said developing means.

121. An image forming apparatus according to claim 107 or 108, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

122. An image forming apparatus according to claim 107 or 108, wherein said first portion and second portion are extended from a developing unit which contains developing means, as said process means, for developing a latent image formed on said photosensitive member and a toner containing portion for containing toner to be used by said developing means and which is swingably mounted to a cleaning unit which contains said photosensitive member and cleaning means, as said process means, for removing residual toner remaining on said photosensitive member.

123. An image forming apparatus according to claim 107 or 108, wherein the main assembly is provided with a helical gear for transmitting a driving force, and a longitudinal end of said photosensitive member in said process cartridge is provided with a helical gear engageable with said helical gear of said main assembly to receive the driving force for rotating said photosensitive member when said process cartridge is mounted to said main assembly, wherein engagement between said helical gears is released by rotation of said process cartridge when said process cartridge is demounted from said main assembly.

124. An image forming apparatus for forming an image on a recording material, comprising:

a first fixed portion;

a second fixed portion;

a mounting member for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with a helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum; and a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum, said cleaning frame including a confining contact surface for contacting said first fixed portion of said main assembly and cooperating with said first projection and second projection to correctly position said process cartridge relative to said main assembly, when said process cartridge is mounted to said main assembly, and said cleaning frame including a releasing contact surface for contacting said second fixed portion of said main assembly when said process cartridge is rotated for demounting from said main assembly, wherein said confining contact surface is provided adjacent a front side of said process cartridge with respect to a mounting direction thereof and in such a side of said process cartridge as is faced substantially upwardly when said process cartridge is mounted to the main assembly, wherein said releasing contact surface is provided adjacent a front side of said process cartridge with respect to the mounting direction thereof and in such a side of said process cartridge as is faced substantially upwardly when said process cartridge is mounted to the main assembly, wherein said releasing contact surface is disposed upstream of said confining contact surface with respect to the mounting direction, the mounting direction crossing with an axis of said photosensitive drum, wherein said releasing contact surface and said confining contact surface are substantially aligned in the mounting direction, and wherein engagement between said helical gears is released by upward rotation of said process cartridge.

125. An image forming apparatus according to claim 124, wherein said first projection and second projection are coaxial.

126. An image forming apparatus according to claim 125, wherein said first projection and second projection are circular around a shaft for supporting said photosensitive drum.

127. An image forming apparatus according to claim 126, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

128. An image forming apparatus according to claim 127, wherein said first portion and said second portion are extended from a cleaning unit which contains said photosensitive drum and said cleaning blade and which is swingably mounted to a developing unit containing said developing roller and a toner containing portion for containing toner to be used by said developing roller.

129. An image forming apparatus according to claim 124, wherein said confining contact portion is provided at each of end portions of said cleaning frame with respect to an axial direction of said photosensitive drum.

130. An image forming apparatus according to claim 129, wherein said confining contact portion has an inclined portion.

131. An image forming apparatus according to claim 124, wherein said releasing contact portion is provided at each of end portions of said cleaning frame with respect to an axial direction of said photosensitive drum.

132. An image forming apparatus according to claim 131, wherein said releasing contact portion has an inclined portion.

133. A method according to claim 132, wherein said releasing contact surface and said confining contact surface define a recess for receiving a member provided in said main assembly and having said first and second portions.

134. A method according to claim 133 wherein said recess is generally U-shaped.

135. An image forming apparatus according to claim 124, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

136. An image forming apparatus according to claim 135, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

137. An image forming apparatus for forming an image on a recording material, comprising:

a first fixed portion;

a second fixed portion;

a helical gear;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting said first fixed portion of said main assembly and cooperating with said first projection and second projection to correctly position said process cartridge relative to said main assembly, when said process cartridge is mounted to said main assembly; and a releasing contact portion, provided on said cleaning frame, for contacting said second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge about a contact portion between said releasing contact portion and said second fixed portion, wherein said first projection and second projection are circular around a shaft for supporting said photosensitive drum, wherein said confining contact portion and said releasing contact portion are in the form of a surface inclined with respect to the mounting direction and formed in a recess in a substantially upwardly facing side of said cleaning frame, and the inclined surface constituting said releasing contact portion is upstream of the inclined surface constituting said confining contact portion with respect to the mounting direction, and wherein the inclined surface constituting said releasing contact portion is a bottom surface of the recess provided at a downstream side with respect to the mounting direction, and the inclined surface of said confining portion is a side wall of the recess, which side wall is upstream of said recess in the mounting direction.

138. An image forming apparatus according to claim 137, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

139. An image forming apparatus according to claim 138, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

140. An image forming apparatus according to claim 137, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

141. An image forming apparatus according to claim 137, wherein said first projection and second projection are coaxial.

142. An image forming apparatus according to claim 141, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly.

143. An image forming apparatus according to claim 142, wherein said first portion and second portion are extended from a cleaning unit which contains said photosensitive drum and said cleaning blade and which is swingably mounted to a developing unit containing said developing roller and a toner containing portion for containing toner to be used by said developing roller.

144. An image forming apparatus according to claim 141, wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

145. An image forming apparatus according to claim 137, wherein said confining contact portion is provided at each of end portions of said cleaning frame with respect to an axial direction of said photosensitive drum.

146. An image forming apparatus according to claim 137, wherein said releasing contact portion is provided at each of end portions of said cleaning frame with respect to an axial direction of said photosensitive drum.

147. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting a first fixing portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said releasing contact portion is contacted to a second fixed portion of said main assembly by raising said process cartridge from said main assembly when said process cartridge is demounted, wherein said first projection and second projection are coaxial and circular around a shaft for supporting said photosensitive drum, wherein said first portion is provided with a first additional projection, for guiding said process cartridge, projected outwardly at a position upstream of said first projection with respect to a mounting direction of said process cartridge, and said second portion is provided with a second additional projection, for guiding said process cartridge, projected outwardly at a position upstream of said second projection with respect to the mounting direction, and wherein said confining contact surface and said releasing contact surface are disposed downstream of said grip portion with respect to the mounting direction.

148. A process cartridge detachably mountable to a main assembly of an image forming apparatus, comprising:

an electrophotographic photosensitive drum;

a charging roller for charging said photosensitive drum ;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting a first fixing portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said releasing contact portion is contacted to a second fixed portion of said main assembly by raising said process cartridge from said main assembly when said process cartridge is demounted, wherein said confining contact portion is provided at each of end portions of said cartridge frame with respect to an axial direction of said photosensitive drum, wherein said confining contact portion has a portion inclined with respect to a mounting direction of said process cartridge, in a recess extending from an upstream side toward a downstream side with respect to the mounting direction, and wherein said confining contact surface and said releasing contact surface are disposed downstream of said grip portion with respect to the mounting direction.

149. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting a first fixing portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said releasing contact portion is contacted to a second fixed portion of said main assembly by raising said process cartridge from said main assembly when said process cartridge is demounted, wherein said releasing contact portion is provided at each of end portions of said cartridge frame with respect to an axial direction of said drum, wherein said releasing contact portion has a portion inclined with respect to a mounting direction of said process cartridge, in a recess extending from an upstream side toward a downstream side with respect to the mounting direction, and wherein said confining contact surface and said releasing contact surface are disposed downstream of said grip portion with respect to the mounting direction.

150. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting a first fixed portion of said main assembly and cooperating with said first projection and second projection to correctly position said process cartridge relative to said main assembly when said process cartridge is mounted to said main assembly; and a releasing contact portion, on said cartridge frame, for contacting a second fixed portion of said main assembly when said process cartridge is demounted from said main assembly, wherein said releasing contact portion is contacted to said second fixed portion of said main assembly by raising said process cartridge from said main assembly when said process cartridge is demounted, wherein said first portion is provided with an outwardly projected third projection, for guiding said process cartridge, at a position which is substantially vertically above said first projection when said process cartridge is mounted to the main assembly, and said second portion is provided with an outwardly projected fourth projection, for guiding said process cartridge, at a position which is substantially vertically above said second projection when said process cartridge is mounted to the main assembly, wherein said first portion is provided with a fifth projection, for guiding said process cartridge, projected outwardly at a position upstream of said first projection with respect to a mounting direction of said process cartridge, and said second portion is provided with a sixth projection, for guiding said process cartridge, projected outwardly at a position upstream of said second projection with respect to the mounting direction, and wherein said confining contact surface and said releasing contact surface are disposed downstream of said grip portion with respect to the mounting direction.

151. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting a first fixing portion of said main assembly and cooperating with said first projection and second projection to correctly position said process cartridge relative to said main assembly, when said process cartridge is mounted to said main assembly; and a releasing contact portion, on said cartridge frame, for contacting a second fixed portion of said main assembly when said process cartridge is demounted from said main assembly, wherein said releasing contact portion is contacted to a second fixed portion of said main assembly by raising said process cartridge from said main assembly when said process cartridge is demounted, wherein said first portion is provided with a first additional projection, for guiding said process cartridge, projected outwardly at a position upstream of said first projection with respect to a mounting direction of said process cartridge, and said second portion is provided with a second additional projection, for guiding said process cartridge, projected outwardly at a position upstream of said second projection with respect to the mounting direction, and wherein said confining contact surface and said releasing contact surface are disposed downstream of said grip portion with respect to the mounting direction.

152. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive member when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting a first fixed portion of said main assembly and cooperating with said first projection and second projection to correctly position said process cartridge relative to said main assembly, when said process cartridge is mounted to said main assembly, a releasing contact portion, provided on said cleaning frame, for contacting a second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a substantially upwardly facing side when said process cartridge is mounted to said main assembly, said releasing contact portion is disposed upstream of said confining contact portion with respect to a mounting direction of said process cartridge the mounting direction crossing with an axis of said photosensitive drum, wherein engagement between said helical gears is released by upward rotation of said process cartridge about a contact portion between said releasing contact portion and said second fixed portion, wherein said first projection and second projection are coaxial and circular around a shaft for supporting said photosensitive drum, and wherein said first portion is provided with a first additional projection, for guiding said process cartridge, projected outwardly at a position upstream of said first projection with respect to the mounting direction, and said second portion is provided with a second additional projection, for guiding said process cartridge, projected outwardly at a position upstream of said second projection with respect to the mounting direction.

153. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting a first fixed portion of said main assembly and cooperating with said first projection and second projection to correctly position said process cartridge relative to said main assembly, when said process cartridge is mounted to said main assembly; and a releasing contact portion, provided on said cleaning frame, for contacting a second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge, wherein said confining contact portion is provided at each of end portions of said cleaning frame with respect to an axial direction of said photosensitive drum, and wherein said confining contact portion has a portion inclined with respect to the mounting direction in a recess extending from an upstream side toward a downstream side with respect to the mounting direction.

154. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for re moving residual toner from said photosensitive drum;

a helical gear engageable with said helical gear of said main assembly to receive the driving force for rotating said photosensitive member when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting a first fixed portion of said main assembly and cooperating with said first projection and second projection to correctly position said process cartridge relative to said main assembly, when said process cartridge is mounted to said main assembly; and a releasing contact portion, provided on said cleaning frame, for contacting a second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge, wherein said releasing contact portion is provided at each of end portions of said cleaning frame with respect to an axial direction of said photosensitive drum, and wherein said releasing contact portion has a portion inclined with respect to the mounting direction, in a recess extending from an upstream side toward a downstream side with respect to the mounting direction.

155. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting said first fixing portion of said main assembly and cooperating with said first projection and second projection to correctly position said process cartridge relative to said main assembly, when said process cartridge is mounted to said main assembly; and a releasing contact portion, on said cartridge frame, for contacting said second fixed portion of said main assembly when said process cartridge is demounted from said main assembly, wherein said releasing contact portion is contacted to said second fixed portion of said main assembly by raising said process cartridge from said main assembly when said process cartridge is demounted, wherein said first projection and second projection are coaxial and circular around a shaft for supporting said photosensitive drum, wherein said first portion is provided with a first additional projection, for guiding said process cartridge, projected outwardly at a position upstream of said first projection with respect to a mounting direction of said process cartridge, and said second portion is provided with a second additional projection, for guiding said process cartridge, projected outwardly at a position upstream of said second projection with respect to the mounting direction, and wherein said confining contact surface and said releasing contact surface are disposed downstream of said grip portion with respect to the mounting direction.

156. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting said first fixing portion of said main assembly and cooperating with said first projection and second projection to correctly position said process cartridge relative to said main assembly, when said process cartridge is mounted to said main assembly; and a releasing contact portion, on said cartridge frame, for contacting said second fixed portion of said main assembly when said process cartridge is demounted from said main assembly, wherein said releasing contact portion is contacted to said second fixed portion of said main assembly by raising said process cartridge from said main assembly when said process cartridge is demounted, wherein said confining contact portion is provided at each of end portions of said cleaning frame with respect to an axial direction of said photosensitive drum, wherein said confining contact portion has a portion inclined with respect to a mounting direction of said process cartridge, in a recess extending from an upstream side toward a downstream side with respect to the mounting direction, and wherein said confining contact surface and said releasing contact surface are disposed downstream of said grip portion with respect to the mounting direction.

157. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a grip portion, on said cartridge frame, for facilitating handling of said process cartridge when it is mounted or demounted;

a confining contact portion, on said cartridge frame, for contacting said first fixing portion of said main assembly and cooperating with said first projection and second projection to correctly position said process cartridge relative to said main assembly, when said process cartridge is mounted to said main assembly; and a releasing contact portion, on said cartridge frame, for contacting said second fixed portion of said main assembly when said process cartridge is demounted from said main assembly, wherein said releasing contact portion is contacted to said second fixed portion of said main assembly by raising said process cartridge from said main assembly when said process cartridge is demounted, wherein said releasing contact portion is provided at each of end portions of said cleaning frame with respect to an axial direction of said photosensitive drum, and wherein said releasing contact portion has a portion inclined with respect to a mounting direction of said process cartridge, in a recess extending from an upstream side toward a downstream side with respect to the mounting direction, and wherein said confining contact surface and said releasing contact surface are disposed downstream of said grip portion with respect to the mounting direction.

158. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum:

a cleaning blade for removing residual toner from said photosensitive drum;

a helical gear engageable with a helical gear of said main assembly to receive a driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting said first fixed portion of said main assembly and cooperating with said first projection and second projection to correctly position said process cartridge relative to said main assembly, when said process cartridge is mounted to said main assembly; and a releasing contact portion, provided on said cleaning frame, for contacting said second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a substantially upwardly facing side when said process cartridge is mounted to said main assembly, said releasing contact portion is disposed upstream of said confining contact portion with respect to a mounting direction of said process cartridges the mounting direction crossing with an axis of said photosensitive drum, wherein engagement between said helical gears is released by upward rotation of said process cartridge, wherein said first projection and second projection are coaxial and circular around a shaft for supporting said photosensitive drum, and wherein said first portion is provided with a first additional projection, for guiding said process cartridge, projected outwardly at a position upstream of said first projection with respect to the mounting direction, and said second portion is provided with a second additional projection, for guiding said process cartridge, projected outwardly at a position upstream of said second projection with respect to the mounting direction.

159. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with a helical gear of said main assembly to receive a driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting said first fixed portion of said main assembly and cooperating with said first projection and second projection to correctly position said process cartridge relative to said main assembly, when said process cartridge is mounted to said main assembly; and a releasing contact portion, provided on said cleaning frame, for contacting said second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge, wherein said confining contact portion is provided at each of end portions of said cleaning frame with respect to an axial direction of said photosensitive drum, and wherein said confining contact portion has a portion inclined with respect to the mounting direction in a recess extending from an upstream side toward a downstream side with respect to the mounting direction.

160. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with a helical gear of said main assembly to receive a driving force for rotating said photosensitive drum when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting said first fixed portion of said main assembly and cooperating with said first projection and second projection to correctly position said process cartridge relative to said main assembly, when said process cartridge is mounted to said main assembly; and a releasing contact portion, provided on said cleaning frame, for contacting said second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge, wherein said releasing contact portion is provided at each of end portions of said cleaning frame with respect to an axial direction of said photosensitive drum, and wherein said releasing contact portion has a portion inclined with respect to the mounting direction, in a recess extending from an upstream side toward a downstream side with respect to the mounting direction.

161. A process cartridge detachably mountable to a main assembly of an image forming apparatus, comprising:

an electrophotographic photosensitive drum;

a charging member for charging said photosensitive drum a developing member for developing a latent image formed on said photosensitive drum;

a cleaning member for removing residual toner from said photosensitive drum;

a cartridge frame;

a first projection for positioning said process cartridge relative to the main assembly when the process cartridge is mounted to the main assembly, said first projection being projected outwardly and coaxially with an axis of said photosensitive drum from a first portion of said cartridge frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cartridge frame adjacent another axial end of said photosensitive drum;

a first long projection, for guiding said process cartridge when said process cartridge is mounted to the main assembly, said first long projection being projected outwardly from said first portion at a position upstream of said first projection with respect to a mounting direction of said process cartridge;

a second long projection, for guiding said process cartridge when said process cartridge is mounted to the main assembly, said second long projection being projected outwardly from said second portion at a position upstream of said second projection with respect to the mounting direction;

a confining contact portion, provided on said cartridge frame at each end portion, for contacting a first fixed portion of said main assembly and for limiting rotation of said process cartridge about said first projection and said second projection, when said process cartridge is mounted to said main assembly; and a releasing contact portion, provided on said cartridge frame at each end portion, for contacting a second fixed portion of said main assembly to provide a pivot of rotation of said process cartridge, when said process cartridge is demounted from said main assembly, wherein said confining contact portion and said releasing contact portion are provided in a recess of such a part of said cartridge frame that becomes a substantially upwardly facing side when said process cartridge is mounted to said main assembly, said releasing contact portion is disposed upstream of said confining contact portion with respect to the mounting direction, the mounting direction crossing with an axis of said photosensitive drum, wherein said confining contact portion and said releasing contact portion are in the form of a portion inclined with respect to the mounting direction, formed in a recess in the substantially upwardly facing side of said cartridge frame, and wherein the inclined surface constituting said releasing contact portion is upstream of the inclined surface constituting said confining contact portion with respect to the mounting direction, and wherein the inclined surface constituting said confining contact portion is a bottom surface of the recess provided at a downstream side with respect to the mounting direction, and the inclined surface of said releasing contact portion is a side wall of the recess, which side wall is upstream of said recess in the mounting direction.

162. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and for limiting rotation of said process cartridge about said first projection and said second projection, when said process cartridge is mounted to said main assembly; and a releasing contact portion, on said cartridge frame, for contacting a second fixed portion of said main assembly when said process cartridge is demounted from said main assembly, wherein said confining contact portion and said releasing contact portion are provided in a recess of such a part of said cartridge frame that becomes a substantially upwardly facing side when said process cartridge is mounted to said main assembly, said releasing contact portion is disposed upstream of said confining contact portion with respect to a mounting direction of said process cartridge the mounting direction crossing with an axis of said photosensitive drum, wherein said confining contact portion and said releasing contact portion are in the form of a portion inclined with respect to the mounting direction, formed in a recess on the substantially upwardly facing side of said cartridge frame, and wherein the inclined surface constituting said releasing contact portion is upstream of the inclined surface constituting said confining contact portion with respect to the mounting direction, and wherein the inclined surface constituting said confining contact portion is a bottom surface of the recess provided at a downstream side with respect to the mounting direction, and the inclined surface of said releasing contact portion is a side wall of the recess, which side wall is upstream of said recess in the mounting direction.

163. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, disposed nearer to said exposure opening than said confining contact portion on said cartridge frame, for contacting a second fixed portion of said main assembly when said process cartridge is demounted from said main assembly, wherein said first projection and second projection are coaxial and circular around a shaft for supporting said photosensitive member, and wherein said first portion is provided with a fifth projection, for guiding said process cartridge when said process cartridge is mounted to the main assembly, projected outwardly at a position upstream of said first projection with respect to a mounting direction of said process cartridge, and said second portion is provided with a sixth projection, for guiding said process cartridge when said process cartridge is mounted to the main assembly, projected outwardly at a position upstream of said second projection with respect to the mounting direction.

164. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly, a releasing contact portion, disposed nearer to said exposure opening than said confining contact portion on said cartridge frame, for contacting a second fixed portion of said main assembly when said process cartridge is demounted from said main assembly, wherein said confining contact portion is provided at each of end portions of said cartridge frame with respect to an axial direction of said photosensitive drum, and wherein said confining contact portion has a portion inclined with respect to a mounting direction of said process cartridge, in a recess extending from an upstream side toward a downstream side with respect to the mounting direction.

165. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion on said cartridge frame, for contacting a first fixed portion of said main assembly and cooperating with said first projection and second projection to correctly position said process cartridge relative to said main assembly, when said process cartridge is mounted to said main assembly; and a releasing contact portion, disposed nearer to said exposure opening than said confining contact portion on said cartridge frame, for contacting a second fixed portion of said main assembly when said process cartridge is demounted from said main assembly, wherein said confining contact portion is provided at each of end portions of said cartridge frame with respect to an axial direction of said photosensitive drum, and wherein said releasing contact portion has a portion inclined with respect to a mounting direction of said process cartridge in a recess extending from an upstream side toward a downstream side with respect to the mounting direction.

166. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and cooperating with said first projection and second projection to correctly position said process cartridge relative to said main assembly, when said process cartridge is mounted to said main assembly; and a releasing contact portion, disposed nearer to said exposure opening than said confining contact portion on said cartridge frame, for contacting a second fixed portion of said main assembly when said process cartridge is demounted from said main assembly, wherein said first portion is provided with an outwardly projected third projection, for guiding said process cartridge when said process cartridge is mounted to the main assembly, at a position which is substantially vertically above said first projection when said process cartridge is mounted to the main assembly, and said second portion is provided with an outwardly projected fourth projection, for guiding said process cartridge when said process cartridge is mounted to the main assembly, at a position which is substantially vertically above said second projection when said process cartridge is mounted to the main assembly, and wherein said first portion is provided with a fifth projection, for guiding said process cartridge when said process cartridge is mounted to the main assembly, projected outwardly at a position upstream of said first projection with respect to a mounting direction of said process cartridge, and said second portion is provided with a sixth projection, for guiding said process cartridge when said process cartridge is mounted to the main assembly, projected outwardly at a position upstream of said second projection with respect to the mounting direction.

167. A process cartridge detachably mountable to a main assembly of an image forming apparatus, comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting a first fixed portion of said main assembly and for limiting rotation of said process cartridge about said first projection and said second projection, when said process cartridge is mounted to said main assembly; and a releasing contact portion, disposed nearer to said exposure opening than said confining contact portion on said cartridge frame, for contacting a second fixed portion of said main assembly when said process cartridge is demounted from said main assembly, and wherein said first portion is provided with a fifth projection, for guiding said process cartridge when said process cartridge is mounted to the main assembly, projected outwardly at a position upstream of said first projection with respect to a mounting direction of said process cartridge, and said second portion is provided with a sixth projection, for guiding said process cartridge when said process cartridge is mounted to the main assembly, projected outwardly at a position upstream of said second projection with respect to the mounting direction.

168. A process cartridge according to claims 1, 24, 63, 73, 74, 88, 98, 147, 148, 150, 151, 163, 166, or 167 wherein said releasing contact surface and said confining contact surface define a recess for receiving a member provided in said main assembly and having said first and second fixed portions.

169. A process cartridge according to claim 168, wherein said recess is generally U-shaped.

170. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive member when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting a first fixed portion of said main assembly and cooperating with said first projection and second projection to correctly position said process cartridge relative to said main assembly, when said process cartridge is mounted to said main assembly; and a releasing contact portion, provided on said cleaning frame, for contacting a second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a substantially upwardly facing side when said process cartridge is mounted to said main assembly, said releasing contact portion is disposed upstream of said confining contact portion with respect to a mounting direction of said process cartridge, the mounting direction crossing with an axis of said photosensitive drum, wherein engagement between said helical gears is released by upward rotation of said process cartridge about a contact portion between said releasing contact portion and said second fixed portion, wherein said first portion is provided with an outwardly projected third projection, for guiding said process cartridge when said process cartridge is mounted to the main assembly, at a position which is substantially vertically above said first projection when said process cartridge is mounted to the main assembly, and said second portion is provided with an outwardly projected fourth projection, for guiding said process cartridge when said process cartridge is mounted to the main assembly, at a position which is substantially vertically above said second projection when said process cartridge is mounted to the main assembly, and wherein said first portion is provided with a fifth projection, for guiding said process cartridge when said process cartridge is mounted to the main assembly, projected outwardly at a position upstream of said first projection with respect to the mounting direction, and said second portion is provided with a sixth projection, for guiding said process cartridge when said process cartridge is mounted to the main assembly, projected outwardly at a position upstream of said second projection with respect to the mounting direction.

171. A process cartridge according to claims 18, 20, 22, 30, 31, 32, 65, 68, 70, 149, 152, 153, 154, 161, 162, 164, 165, or 170, wherein said releasing contact surface and said confining contact surface define said recess, said recess for receiving a member provided in said main assembly and having said first and second fixed portions.

172. A process cartridge according to claims 18, 20, 22, 30, 31, 32, 65, 68, 70, 149, 152, 153, 154, 161, 162, 164, 165, or 170, wherein said recess is generally U-shaped.

173. A process cartridge detachably mountable to a main assembly of an image forming apparatus, said main assembly having a helical gear for transmitting driving force, said process cartridge comprising:

an electrophotographic photosensitive drum;

a charging roller for charging said photosensitive drum;

a developing roller for developing a latent image formed on said photosensitive drum;

a cleaning blade for removing residual toner from said photosensitive drum;

a helical gear engageable with said helical gear of said main assembly to receive the driving force for rotating said photosensitive member when said process cartridge is mounted to said main assembly;

a cleaning frame which contains said photosensitive drum, said charging roller and said cleaning blade;

a developing frame containing said developing roller and a toner containing portion for containing toner to be used by said developing roller, wherein said developing frame is swingably mounted to said cleaning frame;

a first projection for positioning said process cartridge relative to the main assembly when the process cartridge is mounted to the main assembly, said first projection being projected outwardly and coaxially with an axis of said photosensitive drum from a first portion of said cleaning frame adjacent an axial end of said photosensitive drum;

a second projection for positioning said process cartridge relative to the main assembly when the process cartridge is mounted to the main assembly, said second projection being projected outwardly and coaxially with an axis of said photosensitive drum from a second portion of said cleaning frame adjacent another axial end of said photosensitive drum;

a confining contact portion, provided on said cleaning frame for contacting a first fixed portion of said main assembly and cooperating with said first projection and second projection to correctly position said process cartridge relative to said main assembly, when said process cartridge is mounted to said main assembly; and a releasing contact portion, provided on said cleaning frame, for contacting a second fixed portion of said main assembly to provide a pivot of rotation of said process cartridge, when said process cartridge is demounted from said main assembly, wherein said confining contact portion and said releasing contact portion are provided in a recess of such a part of said cleaning frame that becomes a top part when said process cartridge is mounted to said main assembly, said releasing contact portion is disposed upstream of said confining contact portion with respect to a movement direction of said process cartridge when said process cartridge is mounted to the main assembly, and said process cartridge is moved in a direction crossing an axis of said photosensitive drum when said process cartridge is mounted or demounted, wherein engagement between said helical gears is released by upward rotation of said process cartridge, and wherein said first portion is provided with a fifth projection, for guiding said process cartridge, projected outwardly at a position upstream of said first projection with respect to a process cartridge mounting direction, and said second portion is provided with a sixth projection, for guiding said process cartridge, projected outwardly at a position upstream of said second projection with respect to a process cartridge mounting direction.

174. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting said first fixed portion of said main assembly and cooperating with said first projection and second projection to correctly position said process cartridge relative to said main assembly, when said process cartridge is mounted to said main assembly; and a releasing contact portion, disposed nearer to said exposure opening than said confining contact portion on said cartridge frame, for contacting said second fixed portion of said main assembly when said process cartridge is demounted from said main assembly, wherein said first projection and second projection are coaxial and circular around a shaft for supporting said photosensitive member, and wherein said first portion is provided with a fifth projection, for guiding said process cartridge when said process cartridge is mounted to the main assembly, projected outwardly at a position upstream of said first projection with respect to a mounting direction of said process cartridge, and said second portion is provided with a sixth projection, for guiding said process cartridge when said process cartridge is mounted to the main assembly, projected outwardly at a position upstream of said second projection with respect to the mounting direction.

175. An image forming apparatus, according to claims 55, 56, 57, 58, 107, 108, 124, 155, or 174, wherein said releasing contact surface and said containing contact surface define a recess for receiving a member provided in said main assembly and having said first and second fixed portions.

176. An image forming apparatus according to claim 175, wherein said recess is generally U-shaped.

177. An image forming apparatus for forming an image on a recording material, comprising:

a first fixed portion;

a second fixed portion;

mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting said first fixed portion of said main assembly and cooperating with said first projection and second projection to correctly position said process cartridge relative to said main assembly, when said process cartridge is mounted to said main assembly; and a releasing contact portion, disposed nearer to said exposure opening than said confining contact portion on said cartridge frame, for contacting said second fixed portion of said main assembly when said process cartridge is demounted from said main assembly, wherein said confining contact portion is provided at each of end portions of said cleaning frame with respect to an axial direction of said photosensitive drum, and wherein said confining contact portion has a portion inclined with respect to a mounting direction of said process cartridge in a recess extending from an upstream side toward a downstream side with respect to the mounting direction.

178. An image forming apparatus for forming an image on a recording material, comprising:

a first fixed portion;

a second fixed portion; and mounting means for removably mounting a process cartridge to a main assembly of said image forming apparatus, said process cartridge including:

an electrophotographic photosensitive drum;

a charging roller for charging said photosensitive drum;

a developing roller for developing a latent image formed on said photosensitive drum;

a cleaning blade for removing residual toner from said photosensitive drum;

a cartridge frame;

an exposure opening, formed in said cartridge frame, for permitting image light to be projected on said photosensitive drum from said main assembly, when said process cartridge is mounted to said main assembly;

a first projection for positioning said process cartridge relative to the main assembly when the process cartridge is mounted to the main assembly, said first projection being outwardly projected from a first portion of said cartridge frame adjacent an axial end of said photosensitive drum;

a second projection for positioning said process cartridge relative to the main assembly when the process cartridge is mounted to the main assembly, said second projection being outwardly projected from a second portion of said cartridge frame adjacent another axial end of said photosensitive drum;

a confining contact portion, on said cartridge frame, for contacting said first fixed portion of said main assembly and cooperating with said first projection and second projection to correctly position said process cartridge relative to said main assembly, when said process cartridge is mounted to said main assembly; and a releasing contact portion, disposed nearer to said exposure opening than said confining contact portion on said cartridge frame, for contacting said second fixed portion of said main assembly when said process cartridge is demounted from said main assembly, wherein said releasing contact portion is provided at each of end portions of said cartridge frame with respect to an axial direction of said photosensitive drum, and wherein said releasing contact portion has a portion inclined with respect to a mounting direction of said process cartridge, in a recess extending from an upstream side toward a downstream side with respect to the mounting direction.

179. An image forming apparatus according to claims 137, 156, 157, 158, 159, 160, 177, or 178, wherein said releasing contact surface and said confining contact surface define said recess, said recess for receiving a member provided in said main assembly and having first and second fixed portions.

180. An image forming apparatus according to claims 137, 156, 157, 158, 159, 160, 177, or 178 wherein said recess is generally U-shaped.

* * * * *

UNITED STATES PATENT AND TRADEMARK OFFICE

CERTIFICATE OF CORRECTION

PATENT NO. : 6,064,843
DATED : May 16, 2000
INVENTOR(S) : Hironobu Isobe et al.

It is certified that error appears in the above-identified patent and that said Letters Patent is hereby corrected as shown below:

Column 5,
Line 29, "a Laid-Open" should be deleted.
Line 30, "(Laid-open" should read -- (published --.

Column 14,
Line 41, "as" should be deleted.
Line 54, "pressing thereby" should read -- thereby pressing --.

Column 21,
Line 52, "members" should read -- member, --.

Column 22,
Line 61, "s aid" should read -- said --.

Column 24,
Line 2, "mount ing" should read -- mounting --.
Line 5, "to" should read -- to the --.

Column 27,
Line 31, "a n" should read -- an --.
Line 42, "a nd" should read -- and --.

Column 44,
Line 9, "claim 89," should read -- claim 88, --.

Column 51,
Line 22, "claim 133" should read -- claim 133, --.

Column 64,
Line 22, "cartridges" should read -- cartridge, --.

UNITED STATES PATENT AND TRADEMARK OFFICE

CERTIFICATE OF CORRECTION

PATENT NO. : 6,064,843
DATED : May 16, 2000
INVENTOR(S) : Hironobu Isobe et al.

It is certified that error appears in the above-identified patent and that said Letters Patent is hereby corrected as shown below:

Column 66,
Line 47, "drum" should read -- drum; --.
Line 48, "a developing" should begin a new paragraph.

Column 68,
Line 21, "cartridge" should read -- cartridge, --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,064,843
DATED : May 16, 2000
INVENTOR(S) : Hironobu Isobe et al.

It is certified that error appears in the above-identified patent and that said Letters Patent is hereby corrected as shown below:

Column 5,
Line 29, "a Laid-Open" should be deleted.
Line 30, "(Laid-open" should read -- (published --.

Column 14,
Line 41, "as" should be deleted.
Line 54, "pressing thereby" should read -- thereby pressing --.

Column 21,
Line 52, "members" should read -- member, --.

Column 22,
Line 61, "s aid" should read -- said --.

Column 24,
Line 2, "mount ing" should read -- mounting --.
Line 5, "to" should read -- to the --.

Column 27,
Line 31, "a n" should read -- an --.
Line 42, "a nd" should read -- and --.

Column 44,
Line 9, "claim 89," should read -- claim 88, --.

Column 51,
Line 22, "claim 133" should read -- claim 133, --.

Column 64,
Line 22, "cartridges" should read -- cartridge, --.

UNITED STATES PATENT AND TRADEMARK OFFICE

CERTIFICATE OF CORRECTION

PATENT NO. : 6,064,843
DATED : May 16, 2000
INVENTOR(S) : Hironobu Isobe et al.

It is certified that error appears in the above-identified patent and that said Letters Patent is hereby corrected as shown below:

Column 66,
Line 47, "drum" should read -- drum; --.
Line 48, "a developing" should begin a new paragraph.

Column 68,
Line 21, "cartridge" should read -- cartridge, --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*